US007999650B2

(12) United States Patent
Mori

(10) Patent No.: US 7,999,650 B2
(45) **Date of Patent: *Aug. 16, 2011**

(54) COIL DEVICE

(76) Inventor: Ryutaro Mori, Saitama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/516,413

(22) PCT Filed: Nov. 29, 2007

(86) PCT No.: PCT/JP2007/073118

§ 371 (c)(1),
(2), (4) Date: Jul. 7, 2010

(87) PCT Pub. No.: WO2008/066141

PCT Pub. Date: Jun. 5, 2008

(65) Prior Publication Data

US 2010/0295652 A1 Nov. 25, 2010

(30) Foreign Application Priority Data

Nov. 29, 2006 (WO) ..... PCT/JP2006/323788

(51) Int. Cl.
*H01F 5/00* (2006.01)

(52) U.S. Cl. ..... 336/200; 336/223; 336/232

(58) Field of Classification Search ..... 336/200, 336/223, 232

See application file for complete search history.

(56) References Cited

U.S. PATENT DOCUMENTS

| | | | | |
|---|---|---|---|---|
| 5,477,204 | A * | 12/1995 | Li | 336/200 |
| 6,236,297 | B1 * | 5/2001 | Chou et al. | 336/200 |
| 7,221,251 | B2 * | 5/2007 | Menegoli et al. | 336/200 |
| 2001/0022158 | A1 * | 9/2001 | Brcka | 118/723.001 |
| 2003/0085790 | A1 | 5/2003 | Farine | 336/225 |
| 2010/0141369 | A1 | 6/2010 | Mori | 336/200 |
| 2010/0176908 | A1 * | 7/2010 | Mori | 336/226 |

FOREIGN PATENT DOCUMENTS

| | | | |
|---|---|---|---|
| JP | 11-176677 | A | 7/1999 |
| JP | 2000-124024 | A | 4/2000 |
| JP | 2003-188015 | A | 7/2003 |
| JP | 2004-47701 | A | 2/2004 |
| JP | 2006-24772 | A | 1/2006 |
| WO | 2007/063884 | A1 | 6/2007 |

* cited by examiner

*Primary Examiner* — Anh T Mai
(74) *Attorney, Agent, or Firm* — Ladas & Parry, LLP

(57) ABSTRACT

A problem is to provide a sheet-like or thin plate-like coil device that can guarantee a high power transmission efficiency, that has quite little magnetic spurious radiation, that does not cause overheat even in the case of long charge, and that can be manufactured at low cost.

The present coil device is characterized in that two spiral patterns composing a basic pattern are each formed into regular triangle, and are arranged in back to back manner sharing each of base side lines of those two triangles so that the basic pattern is formed into a rhombic S-shape as a whole.

5 Claims, 25 Drawing Sheets

COIL DEVICE

TECHNICAL FIELD

The present invention relates to a sheet-like or thin plate-like coil device, especially to a coil device which is suitable for inductors, transformers, non-contact type power transmission devices or the like.

BACKGROUND OF THE INVENTION

Mr. Ryutaro MORI, the present inventor once proposed a sheet-like or thin plate-like coil device (called planar inductor device), in Japanese Patent Application 2005-346039 (See Patent Document 1), suitable for inductors, transformers, non-contact type power transmission devices or the like.

The above planar inductor device provided various advantages in which a sheet-like or plate-like inductors having intended area can be designed without constraint resulted from coil characteristics, desired power can be obtained corresponding to the area when a pair of devices with the same area are placed facing each other to carry out non-contact type power transmission, and furthermore, free setting of separation cut-off lines can be introduced so that a design flexibility is much improved.

The above planar inductor device, however, had problems still unsolved even now in power transmission efficiency, unnecessary magnetic spurious radiation, unnecessary heat generation, production costs and so on when intended to produce sheet-like or thin plate-like coil devices suitable for inductors or non-contact type power transmission application systems.

Patent Document 1: WO 2007/063884 International Publication Pamphlet

Problems To Be Solved By The Invention

As mentioned above, the planar inductor device proposed by the inventor had problems to be solved in power transmission efficiency, unnecessary magnetic spurious radiation, unnecessary heat generation, production costs and so on when intended to produce sheet-like or thin plate-like coil devices suitable for inductors or non-contact type power transmission application systems. Particularly as for the unnecessary magnetic spurious radiation, high requirements were imposed to designers in order to ensure the normal operation of digital TV circuits or short distance wireless transmission circuits built in a cellular phone since the sheet-like or thin plate-like coil devices of this kind were recently adopted to perform non-contact battery charging of cellular phones.

Of course, also as for the influences upon other metals or other electronic equipments placed near around the cellular phone when charging is performed, high requirements were imposed to designers in order to prevent the metals from overheating by induction heating or other electronic equipments from going down by magnetic radiation.

The present invention was made in view of such problems, and its object is to provide a sheet-like or thin plate like coil device which can ensure the high efficiency in power transmission and extremely low magnetic spurious radiation, which can prevent surrounding metals from overheating in a long term non-contact battery charging, and which can be produced at low manufacturing costs.

Means For Solving Problems

The above technical problems are thought to be solved by a sheet-like or thin plate-like coil device having following features.

Namely, the coil device comprises a plurality of flat coils, a flat coil carry layer for carrying the flat coils arrayed in a plane, a first interconnection layer provided on one side of the flat coil carry layer, and a second interconnection layer provided on the other side of the flat coil carry layer.

A start point of the each flat coil is commonly connected through the first interconnection layer and an end point of the each flat coil is commonly connected through the second interconnection layer.

Thereby, between the first interconnection layer and the second interconnection layer appeared is a parallel connection of the flat coils arrayed in a plane.

Each of the flat coils is composed of a laminated coil made by stacking a plurality of basic patterns made of conductor, and each of basic patterns is formed into nearly S-shaped pattern having two spiral winding patterns of linear conductors each wound in opposite winding directions with each other about each of parallel two axes.

In addition, each of two spiral winding patterns composing the basic pattern may be formed into regular triangle, those two triangle patterns are arranged adjacent to each other sharing the base side of triangle line thereof, so that the basic pattern is formed into rhombic S-shape as a whole.

According to the sheet-like or thin plate-like coil device as mentioned above, electromagnetic conversion performed by using high frequency current is carried out more efficiently and number of vias for an interlayer connection is decreased by half comparing with the case where each S-shape patter is formed by using separate two winding patterns wound in opposite winding directions each other, thereby reduction of production costs is achieved, since each of the two spiral winding patterns composing the nearly S-shaped pattern (the basic pattern) is formed into regular triangle in which magnetic fluxes generated from three sides are all concentrated into a barycenter thereof, those two triangle patterns are arranged adjacent to each other sharing the base side of triangle line thereof, and furthermore the basic pattern is formed into rhombic S-shape as a whole, in addition to the fact that the device has a basic structure proposed by the inventor in Japanese Patent Application 2005-346039.

According to the preferred embodiment of the present invention, the basic patterns each formed into rhombic S-shape may be arranged in dispersed state in each of layers such that outermost circumferential side lines are parallel to each other between adjacent basic patterns, and further spiral winding patterns dispersed in each of layers are axially aligned by corresponding spiral winding patterns between layers.

With such an arrangement, electric current vectors point same direction between adjacent side lines since the outermost circumferential side lines are parallel to each other between adjacent basic patterns, as a result, in case where a plurality of the basic patterns each formed into rhombic S-shape are arranged side by side with their outermost side lines paralleled to each other, for example three such basic patterns are arranged to form a regular hexagon as a whole, three pairs of magnetic poles are equally spaced each other so that magnetic push-pull operation is performed between the magnetic poles, thus unnecessary magnetic radiation is extremely decreased as a whole.

According to the preferred embodiment of the present invention, each of corners of two triangles composing the basic pattern may be cut off along a line perpendicular to a bisector of the angle so that internal angles of each of corners of nearly regular-triangular spiral pattern are all set to 120 degrees.

With such an arrangement, an improvement in power transmission efficiency and a prevention of overheat are both achieved by a decrease in total heat generation due to a heat decrease occurred at each of corners of linear conductor to which high frequency alternating current is applied, since a corner angle of each of corners of the linear conductor is kept at 120 degrees in the present embodiment, while a large amount of heat generation is generally occurred at each of corners of the linear conductor in case where the corner angle is set at a degrees equal to or less than 90 degrees when high frequency alternating current (i.e. 300 KHz to 10 MHz) is applied to the linear conductor.

The sheet-like or thin plate-like coil device of the present invention mentioned above may be produced using a manufacturing technique applied to multilayer print connecting boards (PCB). With such a technique, a desired electromagnetic conversion performance is obtained through a homogenization of parasitic capacitances between adjacent conductors and an improvement of balances between circuit elements, since a cross-sectional shape of linear conductors forming the base pattern, a distance between adjacent linear conductors within same layer, and a distance between linear conductors between different layers can be precisely controlled.

Alternatively, the sheet-like or thin plate-like coil device of the present invention mentioned above may be produced also using a manufacturing technique applied to semiconductor integrated circuits (IC). With such a technique, an operation in much higher frequency can easily be performed due to shortening of moving distance of electrons between base patterns, since the basic patterns themselves can be built into a semiconductor substrate using microscopic fabrication processes. In addition, in particular, in case where the device is configured as a integrated circuit having both analogue circuits and digital circuits, those two kinds of circuits can be operated without being influenced upon each other, since a coil device of the present invention has interconnection layers serving also shield means on its upper and lower surfaces.

EFFECT OF THE INVENTION

According to the present invention, a sheet-like or thin plate-like coil device, in which electromagnetic conversion efficiency is high, high frequency characteristics is good, unnecessary magnetic radiation is small, overheat is prevented in operation, and production costs is low, can be provided.

THE BEST MODE EMBODIMENTS FOR THE PRESENT INVENTION

Preferred embodiments of a sheet-like or thin plate-like coil device of the present invention will be hereinafter described in detail referring to the attaching drawings A sectional view illustrating a structure of a coil device (air core) according to the present invention is shown in FIG. 1. This coil device may be produced using a manufacturing technique applied to multilayer print connection boards (PCB).

As is apparent in the Figure, this coil device is configured by stacking six print connecting boards (flat coil carry layers) consisting of first board B1 to sixth board B6. L1 denotes upper side insulation coating, $L_2$ denotes upper side power source layer (first interconnection layer), $L_3$ denotes lower side power source layer (second interconnection layer), and $L_4$ denotes lower side insulation layer.

Upper side power source layer $L_2$ is configured as a conductive surface (solid conductor) having conductivity with uniformity in the whole surface except magnetic flux penetrating holes H1 and H2.

Six print connecting boards consisting of first board B1 to sixth board B6 serves first winding board to sixth winding board respectively, on each of boards formed are a first winding pattern to a sixth winding pattern each serves a flat coil.

An example of those winding patters 1P to 6P is depicted as an unit pattern P on an upper blanking, space of the FIG. 1. As is apparent in the Figure, this unit pattern consists of a first portion P-1 formed by winding a linear conductor in a counter-clockwise direction about a coil axis from inner to outer circumference and a second portion P-2 formed by winding a linear conductor in a clockwise direction about another coil axis from outer to inner circumference. First portion P-1 and second portion P-2 are each formed into nearly regular triangular spiral pattern and those two triangular spiral patterns are arranged back to back with respect to each other sharing outermost base line M thereof, thereby the arrangement is viewed like a rhombic shape as a whole.

First layer pattern 1P to sixth layer patter 6P are formed slightly different between even-numbered ones and odd-numbered ones so that current flow directions become same between adjacent upper and lower layers.

To explain connecting relation between adjacent layer patterns from upper layer to lower layer in turn, upper side power source layer L2 is connected to first portion 1P-1 of first layer winding pattern 1P through via V1. Inner end of second portion 1P-2 of first layer winding pattern 1P is connected to second portion 2P-2 of second layer winding pattern 2P through via V2.

Similarly, each of layer winding patterns is connected in turn to the layer pattern of one layer lower, alternately changing portions between first portion P-1 and second portion P-2, through via V3 to V6.

Finally, first portion 6P-1 of sixth layer pattern 6P is connected to lower side power source layer L3 through via V7. Thus, six S-shaped unit patterns P are connected in series between upper side power source layer L2 and lower side power source layer L3. Current inputted at an inner end of first portion P-1 flows from inner to outer circumference within first portion P-1 in a counter-clockwise direction, then reaches to base side portion M of triangle, and successively flows from outer to inner periphery within second portion P-2 in a clockwise direction. Accordingly, magnetic fluxes are generated in opposite direction each other between first portion P1 and second portion P2 within each of unit patterns P, then so-called "magnetic push-pull operation" is performed in each of winding pattern 1P to 6P, those magnetic fluxes are added by each of first portion P1 and second portion P2 in opposite direction, thereby a charging operation and a discharging operation of magnetic energy are performed repeatedly in high efficiency.

Plain views illustrating each of boards B1 to B6 in a coil device (air core) according to the present invention are shown in FIG. 2 to FIG. 9. In particular, a plain view illustrating upper side power source layer L2 is shown in FIG. 2. Note that an encompassing square line in the Figure shows an outline of the board.

As shown in the Figure, board material exposure area 103 of regular hexagonal shape is placed on nearly whole surface around center of the board surrounded by conductive coating area 101. Three lead patterns 102 are extended toward nearly center of board material exposure area 103 from the conductive coating area 101, and via V1 is placed at each of leading ends of those lead patterns 102. Via V1 is provided for connecting upper side power source layer L2 to first layer winding pattern 1P. Through hole TH is placed on upper right portion of the board for communicating power source VDD to lower most layer board.

Plain view illustrating a board B1 composing first layer winding pattern 1P in a coil device (air core) according to the present invention is shown in FIG. 3.

As shown in the Figure, there is a conductive pattern of regular hexagonal shape which is composed by closely combining three unit patterns 1PA, 1PB, 1PC of rhombic shape together so that outermost conductive sidelines of each of the patterns are in parallel with each other.

Each of those three unit patterns 1PA, 1PB, 1PC has first portion 1PA-1, 1PB-1, 1PC-1 and second portion 1PA-2, 1PB-2, 1PC-2.

An inner end of each of first portions 1PA-1, 1PB-1, 1PC-1 is power supplied from upper power source layer L2 through via V1. An inner end of each of second portions 1PA-2, 1PB-2, 1PC-2 is connected to second layer winding pattern 2P through via V2.

As is apparent in the Figure, a spiral pattern of each of first portions 1PA-1, 1PB-1, 1PC-1 is formed into regular triangle spiral pattern turning in a counter-clockwise direction from inner to outer circumference, and a spiral pattern of each of second portions 1PA-2, 1PB-2, 1PC-2 is formed into regular triangle spiral pattern turning in a clockwise direction from outer to inner circumference.

In other words, each of first portions 1PA-1, 1PB-1, 1PC-1 and each of second portions 1PA-2, 1PB-2, 1PC-2 composing each of unit patterns 1PA, 1PB, 1PC consists of two triangles arranged back to back sharing a base side so as to form a rhombic shape as a whole.

Accordingly, as explained later in detail, a N(north) pole and a S(south) pole (see FIG. 23) each positioned at a center of first portion and second portion respectively are equally spaced between adjacent poles so that magnetic fluxes will not extend outwardly from the regular hexagonal area when those three unit patterns of rhombic shape are closely combined with their outermost circumferential side lines adjacent to each other in parallel to form a regular hexagon as a whole.

According to the regular hexagonal winding patter composed of a combination of three rhombic unit patterns, magnetic fluxes generated by each current flowing each of three sidelines of regular triangle winding pattern are efficiently concentrated into corresponding magnetic poles while the fluxes generated will not leak theoretically out of a regular hexagonal closed area, furthermore a high efficiency of operation is ensured due to an optimized magnetic balance since two portions (P-1, P-2) composing each of unit patterns 1PA, 1PB, and 1PC have a symmetrical same shape (see FIG. 23).

A plain view illustrating a board (B2) composing second layer winding pattern in a coil device (air core) according to the present invention is shown in FIG. 4. In the Figure, 2PA, 2PB, and 2PC each denotes a first, a second, and a third unit pattern respectively. 2PA-1, 2PB-1, and 2PC-1 each denotes first portion of each of a first, a second, and a third unit paterns. 2PA-2, 2PB-2, and 2PC-2 each denotes second portion of each of a first, a second, and a third unit paterns. TH denotes through hole, 121 denotes board material exposure area, V2 denotes via communicating to first layer winding pattern, and V3 denotes via communicating to third layer winding pattern.

A plain view illustrating a board (B3) composing third layer winding pattern in a coil device (air core) according to the present invention is shown in FIG. 5. In the Figure, 3PA, 3PB, and 3PC each denotes a first, a second, and a third unit pattern respectively. 3PA-1, 3PB-1, and 3PC-1 each denotes first portion of each of a first, a second, and a third unit paterns. 3PA-2, 3PB-2, and 3PC-2 each denotes second portion of each of a first, a second, and a third unit paterns. 131 denotes board material exposure area, V3 denotes via communicating to second layer winding pattern, and V4 denotes via communicating to fourth layer winding pattern.

A plain view illustrating a board (B4) composing fourth layer winding pattern in a coil device (air core) according to the present invention is shown in FIG. 6.

In the Figure, 4PA, 4PB, and 4PC each denotes a first, a second, and a third unit pattern respectively. 4PA-1, 4PB-1, and 4PC-1 each denotes first portion of each of a first, a second, and a third unit paterns. 4PA-2, 4PB-2, and 4PC-2 each denotes second portion of each of a first, a second, and a third unit paterns. 141 denotes board material exposure area, V4 denotes via communicating to third layer winding pattern, and V5 denotes via communicating to fifth layer winding pattern.

A plain view illustrating a board (B5) composing fifth layer winding pattern in a coil device (air core) according to the present invention is shown in FIG. 7.

In the Figure, 5PA, 5PB, and 5PC each denotes a first, a second, and a third unit pattern respectively. 5PA-1, 5PB-1, and 5PC-1 each denotes first portion of each of a first, a second, and a third unit paterns. 5PA-2, 5PB-2, and 5PC-2 each denotes second portion of each of a first, a second, and a third unit paterns. 151 denotes board material exposure area, V5 denotes via communicating to fourth layer winding pattern, and V6 denotes via communicating to sixth layer winding pattern.

A plain view illustrating a board (B6) composing sixth layer winding pattern in a coil device (air core) according to the present invention is shown in FIG. 8.

In the Figure, 6PA, 6PB, and 6PC each denotes a first, a second, and a third unit pattern respectively. 6PA-1, 6PB-1, and 6PC-1 each denotes first portion of each of a first, a second, and a third unit paterns. 6PA-2, 6PB-2, and 6PC-2 each denotes second portion of each of a first, a second, and a third unit paterns. 161 denotes board material exposure area, V6 denotes via communicating to fifth layer winding pattern, and V7 denotes via communicating to lower side power source layer winding pattern.

A plain view illustrating a board (L3) composing lower side power source layer (L3) in a coil device (air core) according to the present invention is shown in FIG. 9.

In the Figure, 171 denotes conductive coating area, 172 denotes board material exposure area, 173 denotes GND terminal, T denotes through hole, 174 denotes lead pattern, and V7 denotes via communicating to sixth layer winding pattern.

As explained above, according to the coil device shown in FIG. 1 to FIG. 9, as is apparent from a sectional view shown in FIG. 1, since a regular triangle composing first portion P-1 and a regular triangle composing second portion P-2 are arranged closely adjacent to each other sharing a base side line M (see FIG. 1), a cancellation of magnetic fluxes due to two currents flowing in opposite direction, which would often occur when those two portions P-1 and P-2 consisted of separate two regular triangles, is avoided. Thus, this also contributes to an improvement in efficiency of a coil device of the present embodiment. Namely, the current flowing common portions M (M1 to M6) directly contributes to a magnetic push-pull operation in which a prescribed direction component of magnetic fluxes flowing at a center of first portion P-1 are added with each other while a prescribed direction component of magnetic fluxes at a center of second portion P-2 are subtracted with each other.

Incidentally, in the embodiment described above, first portion P-1 and second portion P-2 are both composed of so-called "air-cored coil" in which a core made of magnetic material is not provided. Alternatively, those portions may be composed of so-called "cored coil" in which a core made of magnetic material is provided.

An embodiment of a coil device according to the present invention using such a cored coil is illustrated in FIG. 10 to FIG. 18. In those Figures, K1 denotes a tubular core penetrating first portion P-1 along a center axis thereof, K2 denotes a tubular core penetrating second portion P-2 along a center axis thereof. These cores K1 and K2 are each formed into regular triangular cross-sectional shape. More precisely to say, a cross-sectional shape may be expressed as a regular triangle in which each of three corners is cut off along a line perpendicular to the bisector thereof, thereby may be expressed as an irregular hexagonal cross-sectional shape. As described later, this irregular hexagonal cross-sectional shape corresponds to a configuration in which an inner angle of each of corners included in winding patterns surrounding the irregular core becomes 120 degrees.

Incidentally, details as for winding patterns shown in FIG. 11 to FIG. 18 are all identical with those of the embodiment described above, except having core penetrating holes 104, 112, 122, 132, 142, 152, 162, and 175 for penetrating tubular cores K1 and K2, therefore details as for identical configurations will be abbreviated.

Next, design rules applied to the above mentioned embodiments of a coil device according to the present invention will be described below in detail referring to FIG. 19 to FIG. 24.

Countermeasures for a heat generation caused by high frequency alternate current operation is illustrated in FIG. 19. As shown in the Figure, a regular triangle composing first portion and second portion of an unit pattern, as illustrated by example of three apexes P, Q, R, is cut off along a straight line X perpendicular to a bisector of the corner angle. As the result, inner angles of corners on a linear conductor 200 formed into a spiral pattern are all 120 degrees so that a heat generation caused by high frequency alternate current is limited effectively.

Clearances between oblique lines and between lines at each of corners are illustrated in FIG. 20. As shown in the Figure, the clearance between adjacent lines at each of corners is expressed as 2*a* if the clearance between adjacent oblique lines is defined as a. With such a configuration, winding patterns corresponding to each of layers are stacked with each other in order between layers, and furthermore angles of corners included in a linear conductor formed into a spiral winding pattern are unified into 120 degrees, thereby total amount of heat generation is limited effectively.

Design values of portions in a first portion of the basic pattern are illustrated in FIG. 21. Lengths of three side lines A, B, C are equally defined to b, as is apparent from the definition of a regular triangle, width (W) at outermost end between adjacent two radial lines each connecting each of 120 degrees corners pair corresponding to two corners of the triangle is defined to a, and width (W) at outermost end between adjacent two radial lines connecting each of 120 degrees corners pair Current corresponding to remaining one corner of the triangle is defined to a/2. According to such a design rule, clearance between conductors is optimized and a reduction in heat generation is performed.

Current vectors corresponding to currents flowing linear conductors between basic patterns are illustrated in FIG. 22. As described before, directions of current flowing through conductors coincide with each other between adjacent basic patterns, when three basic patterns are combined to form regular polygonal shape. Thus, magnetic fields are effectively added with each other to perform an electromagnetic conversion of extremely high efficiency.

Magnetic flux flow in case where three basic patterns are combined to form a regular polygonal shape as a whole are illustrated in FIG. 23. As shown in the Figure, as indicated by arrows, three pairs of magnetic poles (N1, S1), (N2, S2), and (N3, S3) which are corresponding to each of three basic patterns respectively are equally spaced with each other, and each of those three basic patterns are commonly connected in parallel between power source terminals so that each of magnetic fluxes generated from each of magnetic poles are all flown into adjacent magnetic hetero-polarity poles and magnetic fluxes generated will not leak out of the regular polygonal area defined by the three basic patterns. Thus, according to the coil device having the regular polygonal winding pattern as shown in FIG. 23, for example, even in case where it is built within a bottom plate or a lid plate of cellular phones, it is least disruptive to adjacently placed electronic circuitries, actually, it was confirmed by the inventor that a looking and listening of digital N or an operation in short distance data communication cards can be performed without any problem.

Another embodiment of the present invention in which sixteen basic patterns are combined to form elongated polygonal shape is illustrated in FIG. 24. As shown in the Figure, it will be understood that arbitrarily-sized planar coils can be realized by arranging a plurality of unit polygonal patterns, each consisting of three rhombic basic patterns, adjacent to each other in order. Accordingly, there can be various kind of applications such as non-contact battery charging of cellular phones, mouse battery charging by a mouse pad in cordless mouse system, and other portable electronic equipments battery charging in high efficiency, by adjusting such a planar coil to an appropriate size. Particularly, once again, since a coil device of the present invention has advantages of not only high efficiency but also least unnecessary magnetic radiation (leakage) and least overheat possibility, even if introduced to cellular phones as a built in coil for receiving power in non-contact power transmission system, a looking and listening of digital TV or an operation in short distance data communication cards can be performed without any problem, thereby it is believed that the device will contribute to the commercial viability of such a non-contact power transmission system.

Finally, a frequency characteristics as an inductor of the present invention is illustrated with comparison in FIG. 25. In the Figure, 201 denotes a data of conventional tubular coil, 202 denotes a data of conventional flat coil, 203 denotes a data of sheet coil of the present invention, and 204 denotes a data of tubular S-shaped coil in frequency characteristics of inductance (L).

Here, tubular coil 201 is a coil prepared by winding 36 turns a conductive wire of 0.7 mm in diameter around a straight tubular core of 12 mm in outer diameter. Flat coil 202 is a flat coil having 35 mm in diameter and prepared by spirally winding 24 turns in a plane a ribbon wire of 0.8 mm×0.4 mm in sectional shape. Sheet coil 203 is a coil according to the present invention, and a flat coil prepared by connecting three sets of coil units in parallel, each coil unit having eight (layered) S-shaped coils in series, each S-shaped coil consisting of two triangular eight turns coil connected with each other to form S-shaped (rhombic) coil. Tubular S-shaped coil 204 is a coil prepared by winding eighteen S-turns a conductive wire of 0.7 mm in diameter around two parallel tubular cores of 12 mm in outer diameter.

As is apparent in the graph, according to the sheet coil 203 of the present invention, it is confirmed that a stabilized inductance value not depending on frequency is obtained, comparing with other coils, in the frequency range higher than 12.8 KHz. In particular, it is confirmed that inductance value much higher than the one, obtained by the flat coil 202 which is recently expected to be introduced into non-contact power transmission system, in the frequency range higher than 25.2 KHz.

Incidentally, in the sheet coil curve indicated by numeral 203, a frequency value of about 25.6 KHz corresponding to the peak impedance value can be varied arbitrarily based on the selection of a circuitry resonance point. Accordingly, according to the sheet coil of the present invention, a high frequency characteristics generally required to this kind of coils is fully satisfied since transmissible power per unit volume is large and stabilized and high inductance is obtained, in addition to that the device has advantages of high transmission efficiency, less unnecessary magnetic radiation, and less heat generation and so on.

In other words, according to a sheet coil of the present invention, it is also understood that inductance value per unit volume value is so large. Accordingly, as a future prospect, it is also expected that the sheet coil will be built within a main circuit board itself of a cellular phones as an inductor element. Furthermore, this will also bring a technical advantage that an inductance element does not require the aria for its mounting in the surface of circuit board.

INDUSTRIAL APPLICABILITY

According to the present invention, it is possible to provide a coil device which has a high power transmission efficiency, a least unnecessary magnetic radiation, a least heat generation, a high and stabilized inductance in high frequency range, and a low cost production possibility.

BRIEF DESCRIPTION OF THE SYMBOLS

Figure 1:
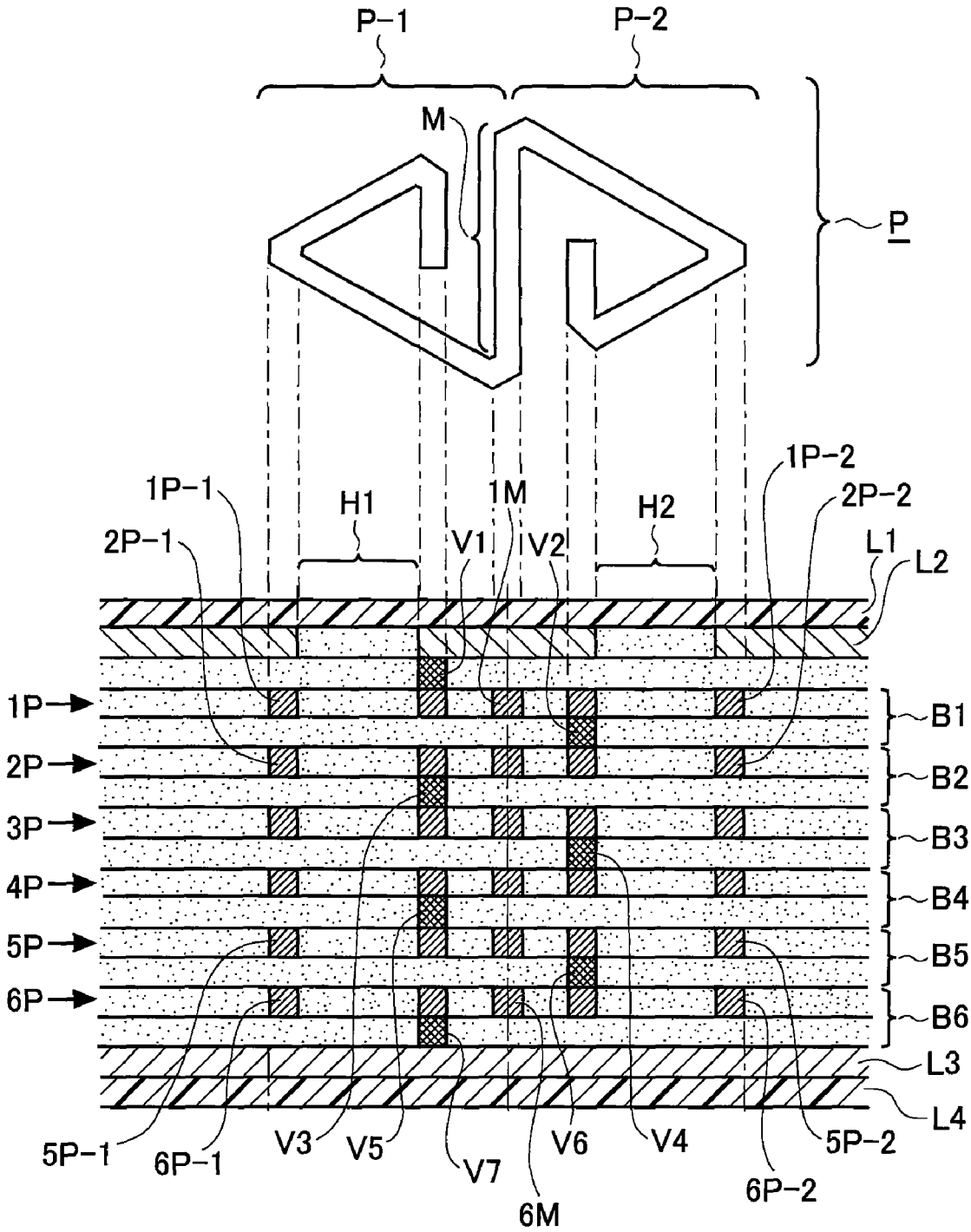
FIG. 1 is a sectional view illustrating a configuration of a coil device (air core) of the present invention.
Figure 2:
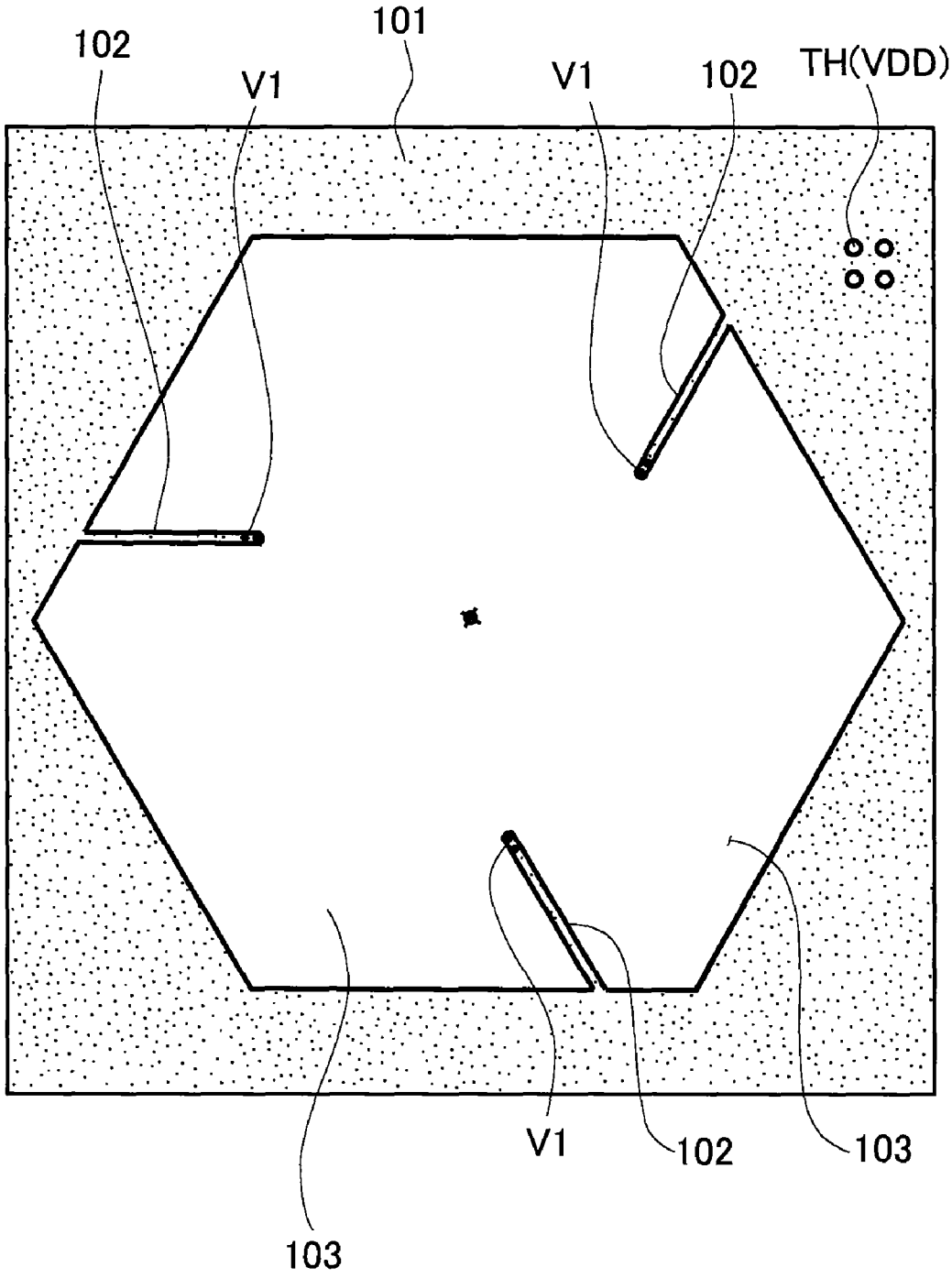
FIG. 2 is a plain view of an upper side power source layer (L2) of a coil device (air core) of the present invention.
Figure 3:
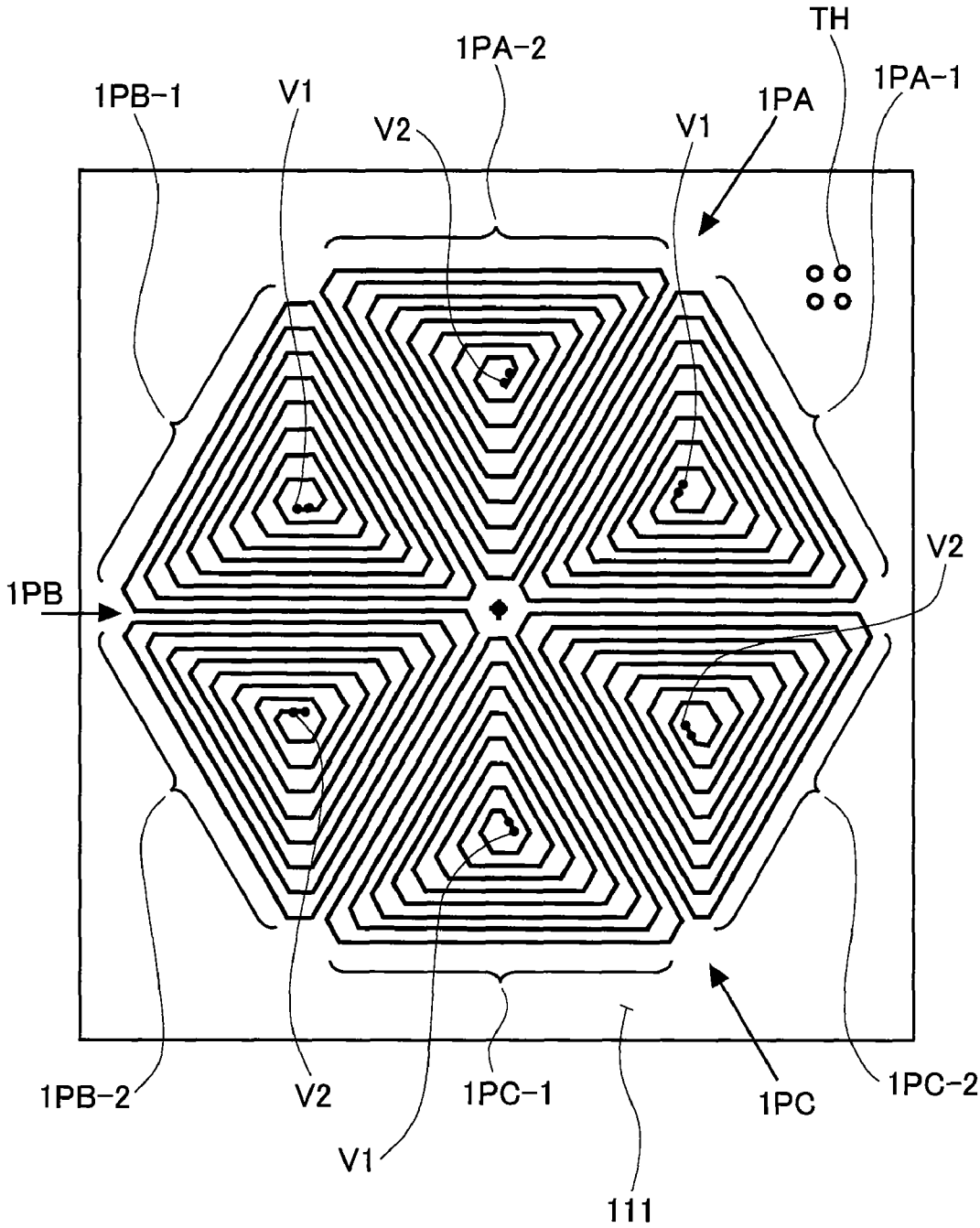
FIG. 3 is a plain view of a board (B1) composing a first layer winding pattern of a coil device (air core) of the present invention.
Figure 4:
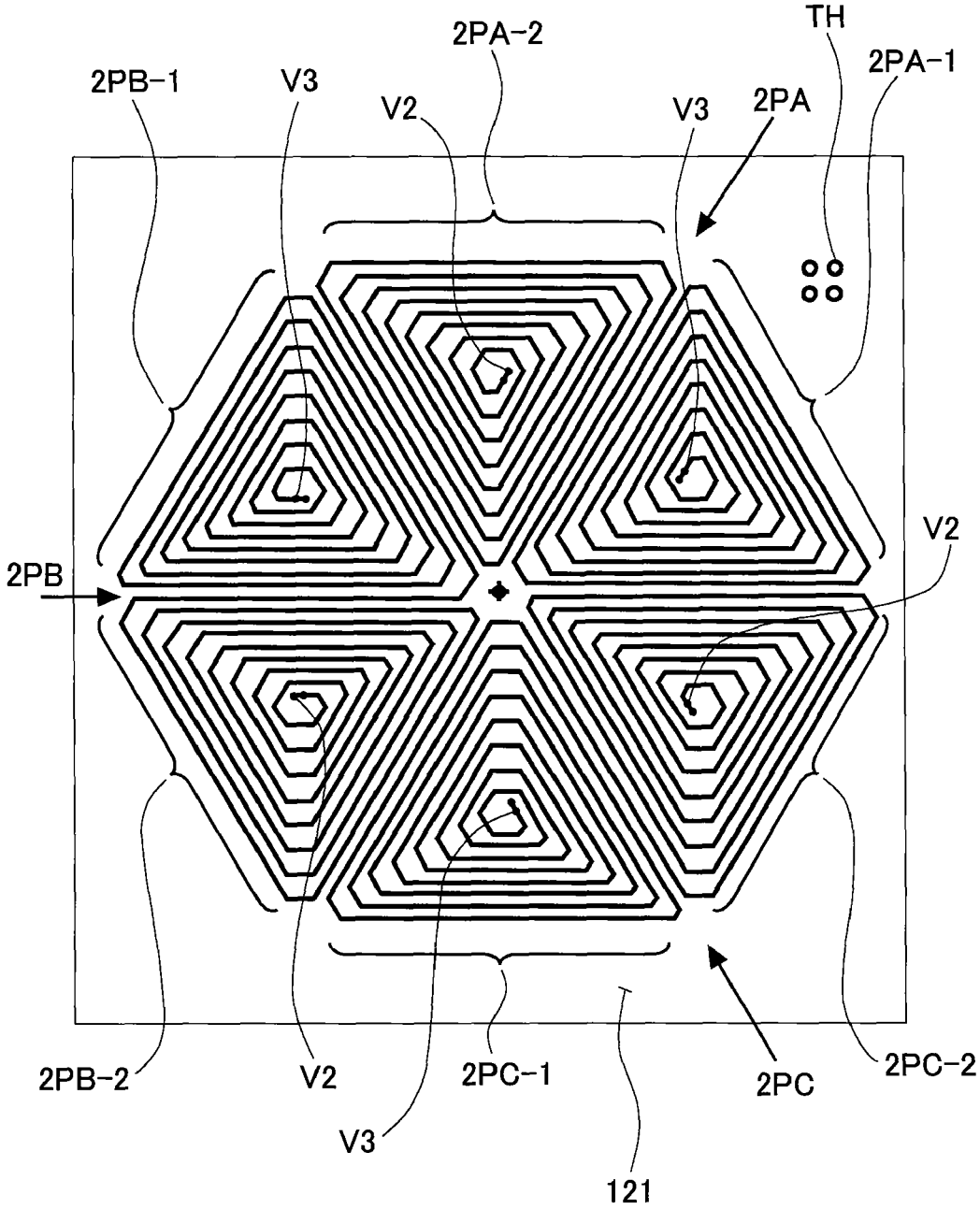
FIG. 4 is a plain view of board (B2) composing a second layer winding patterns of a coil device (air core) of the present invention.
Figure 5:
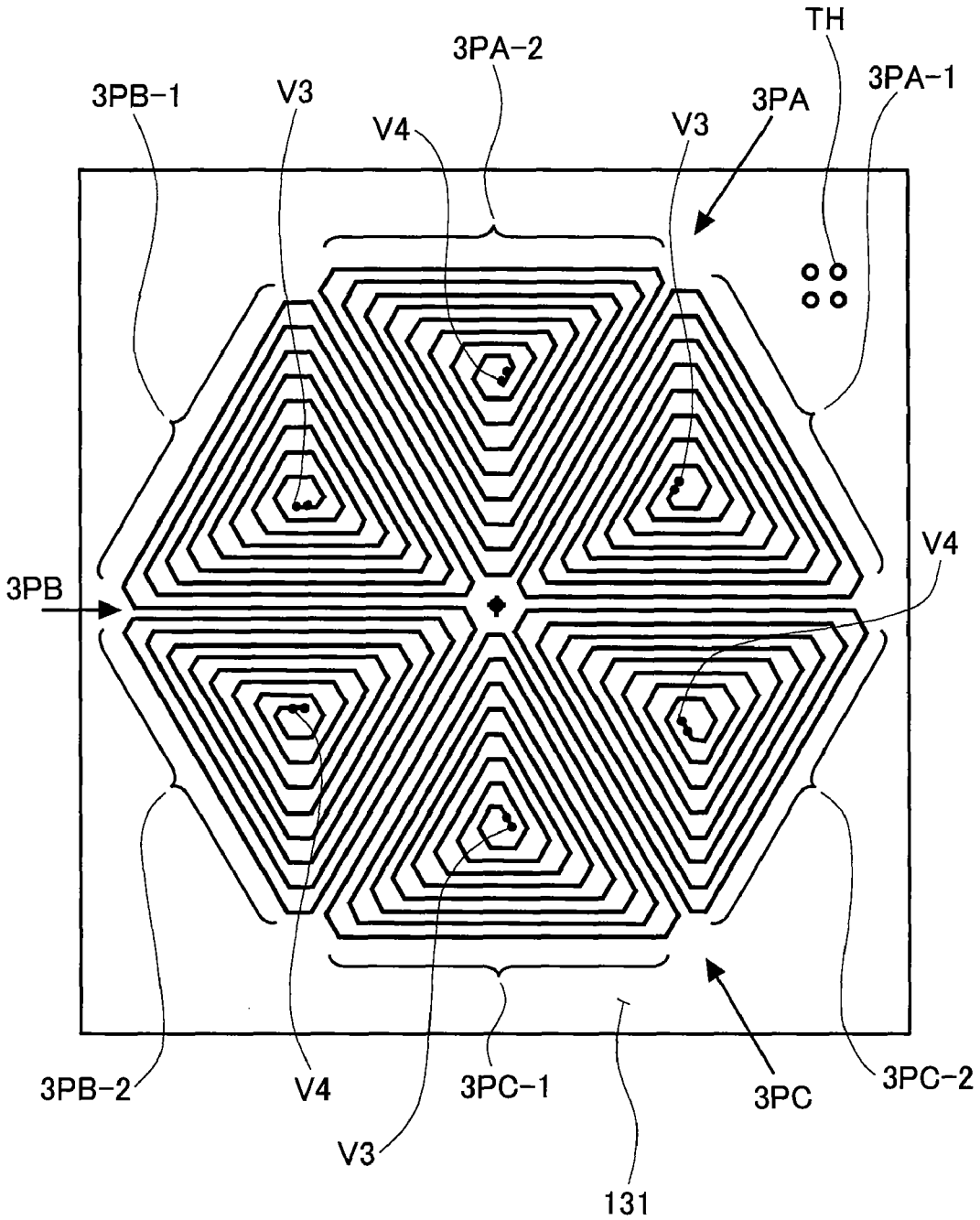
FIG. 5 is a plain view of board (B3) composing a third layer winding patterns of a coil device (air core) of the present invention.
Figure 6:
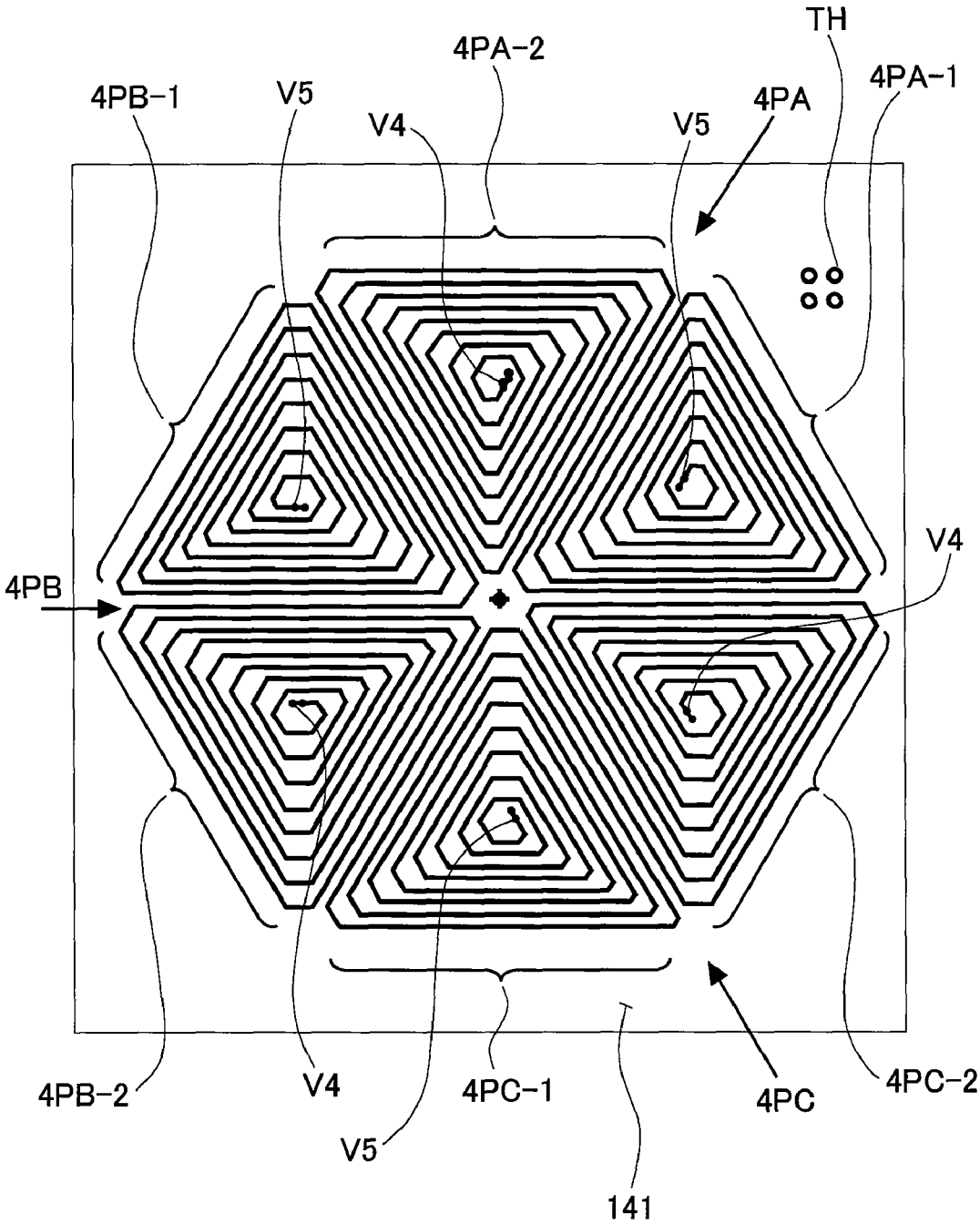
FIG. 6 is a plain view of board (B4) composing a fourth layer winding patterns of a coil device (air core) of the present invention.
Figure 7:
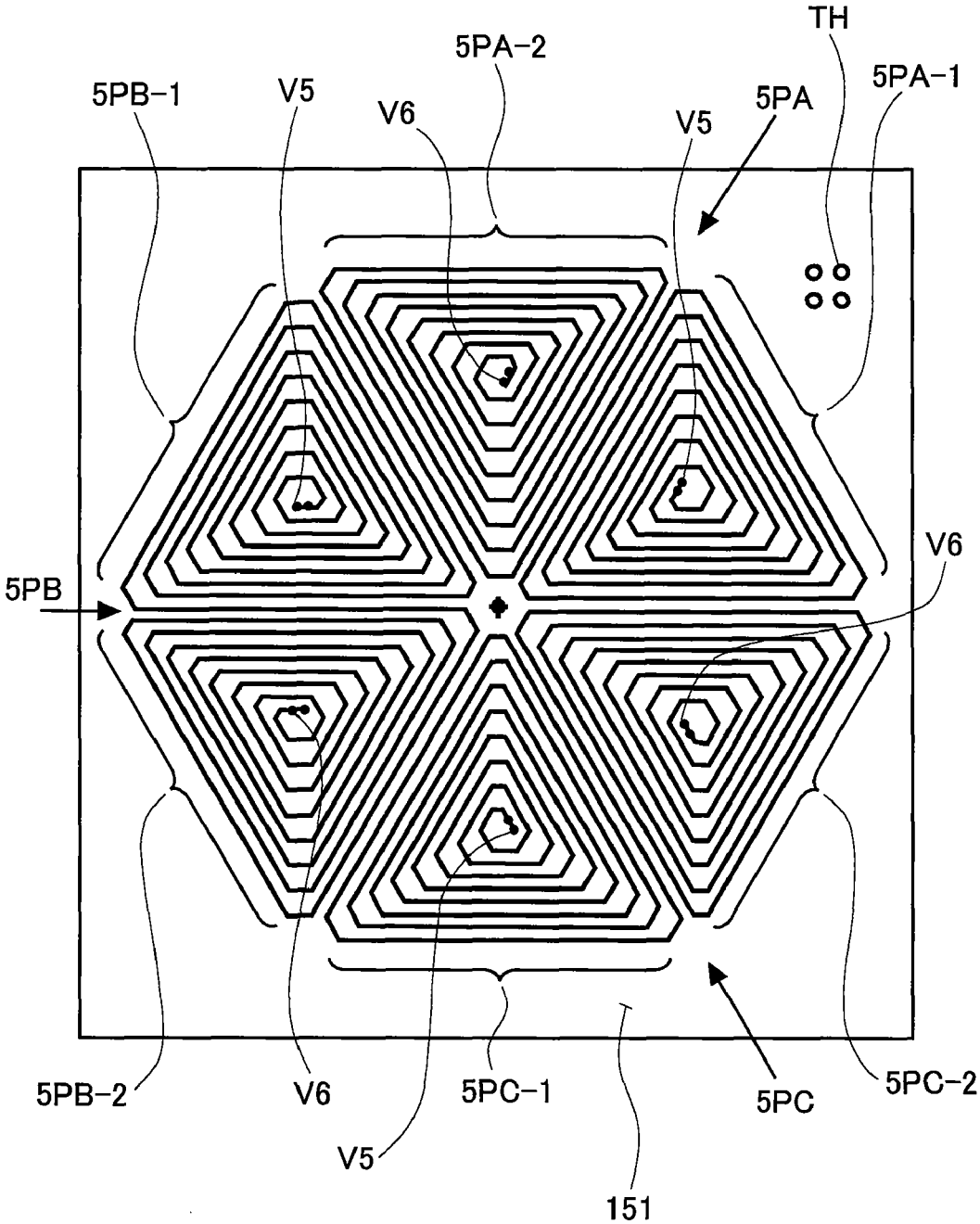
FIG. 7 is a plain view of board (B5) composing a fifth layer winding patterns of a coil device (air core) of the present invention.
Figure 8:
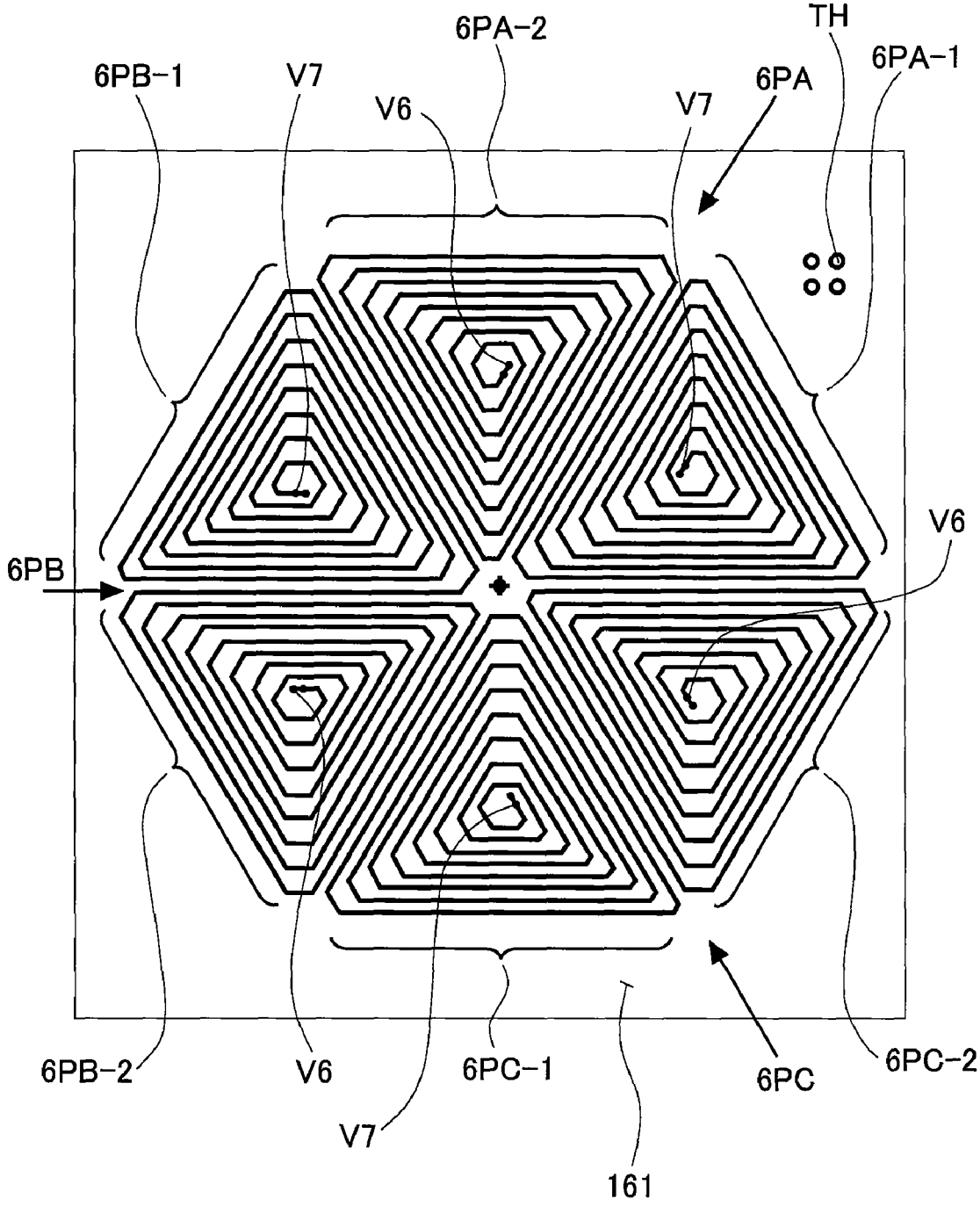
FIG. 8 is a plain view of board (B6) composing a sixth layer winding patterns of a coil device (air core) of the present invention.
Figure 9:
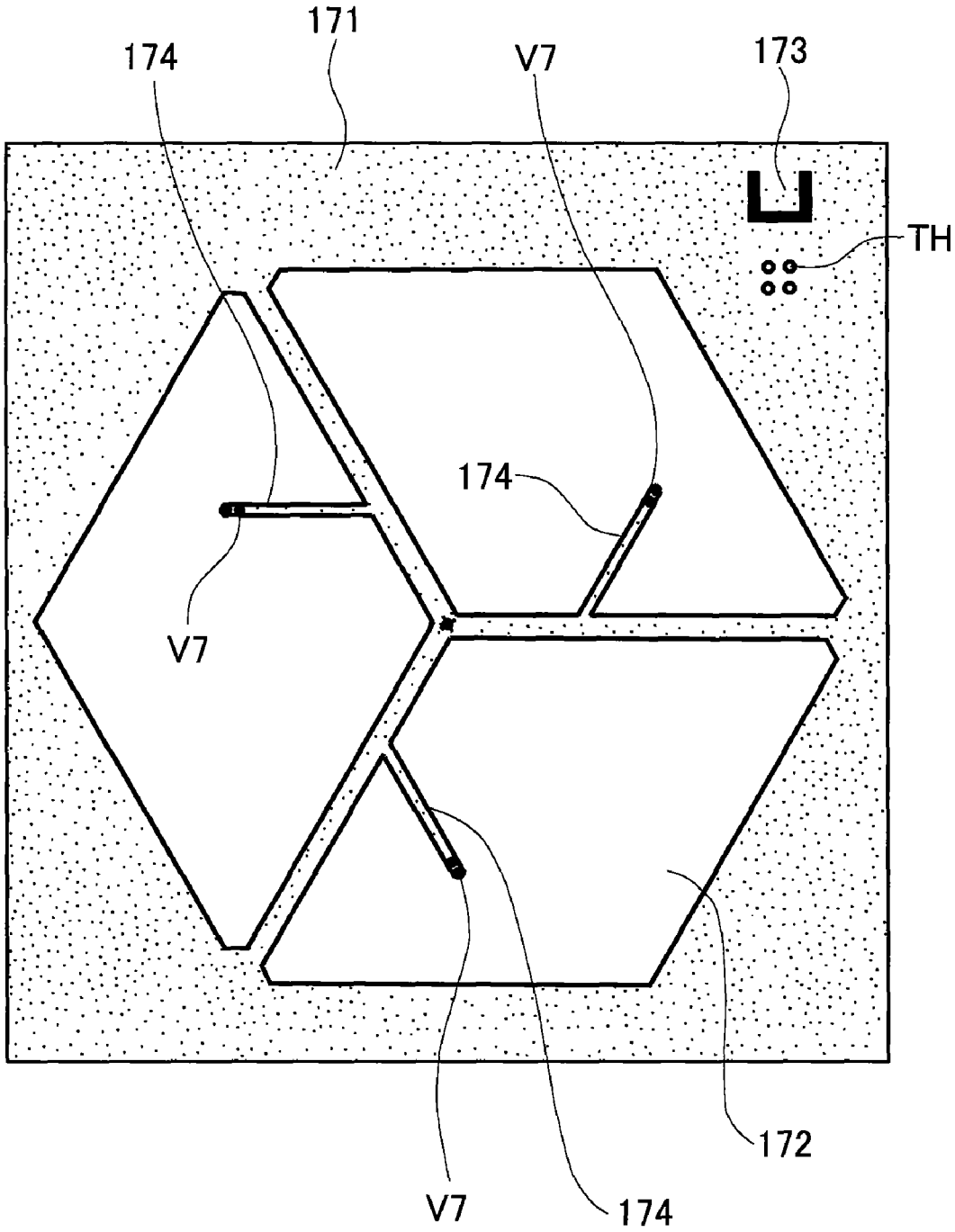
FIG. 9 is a bottom view of board (L3) composing a lower side power source layer (GND) of a coil device (air core) of the present invention.
Figure 10:
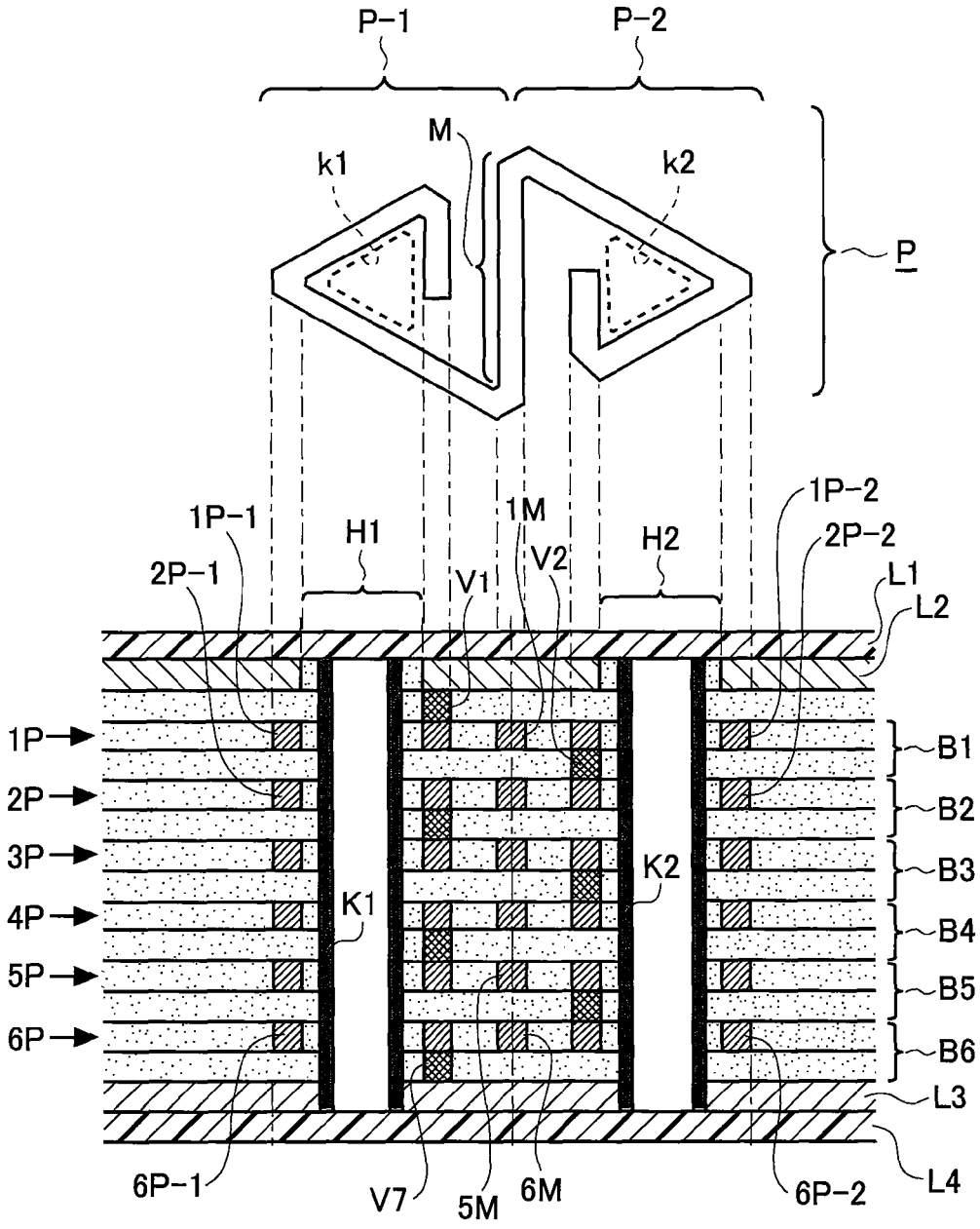
FIG. 10 is a sectional view illustrating a configuration of a coil device (cored) of the present invention.
Figure 11:
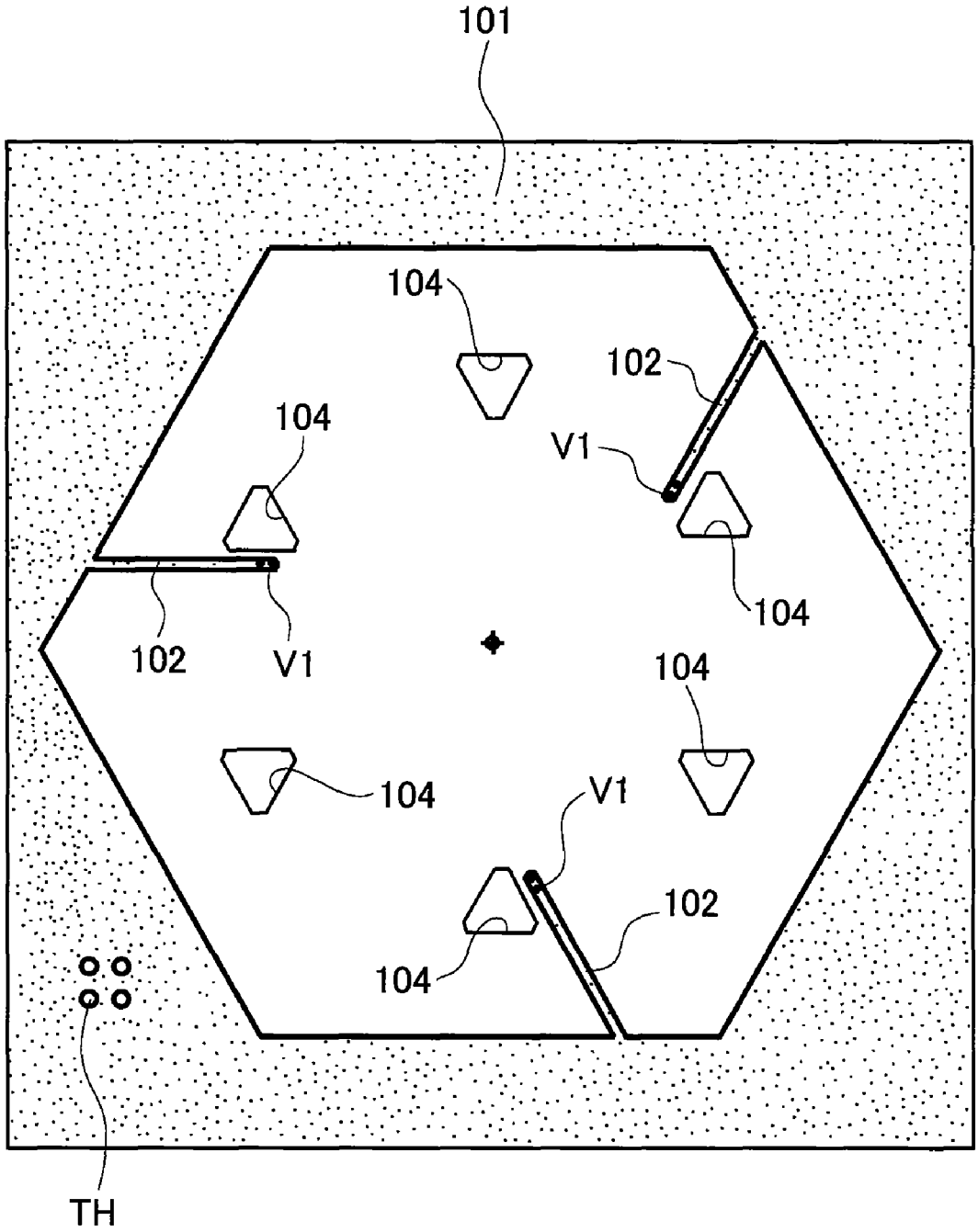
FIG. 11 is a plain view of an upper side power source layer (L2) of a coil device (cored) of the present invention.
Figure 12:
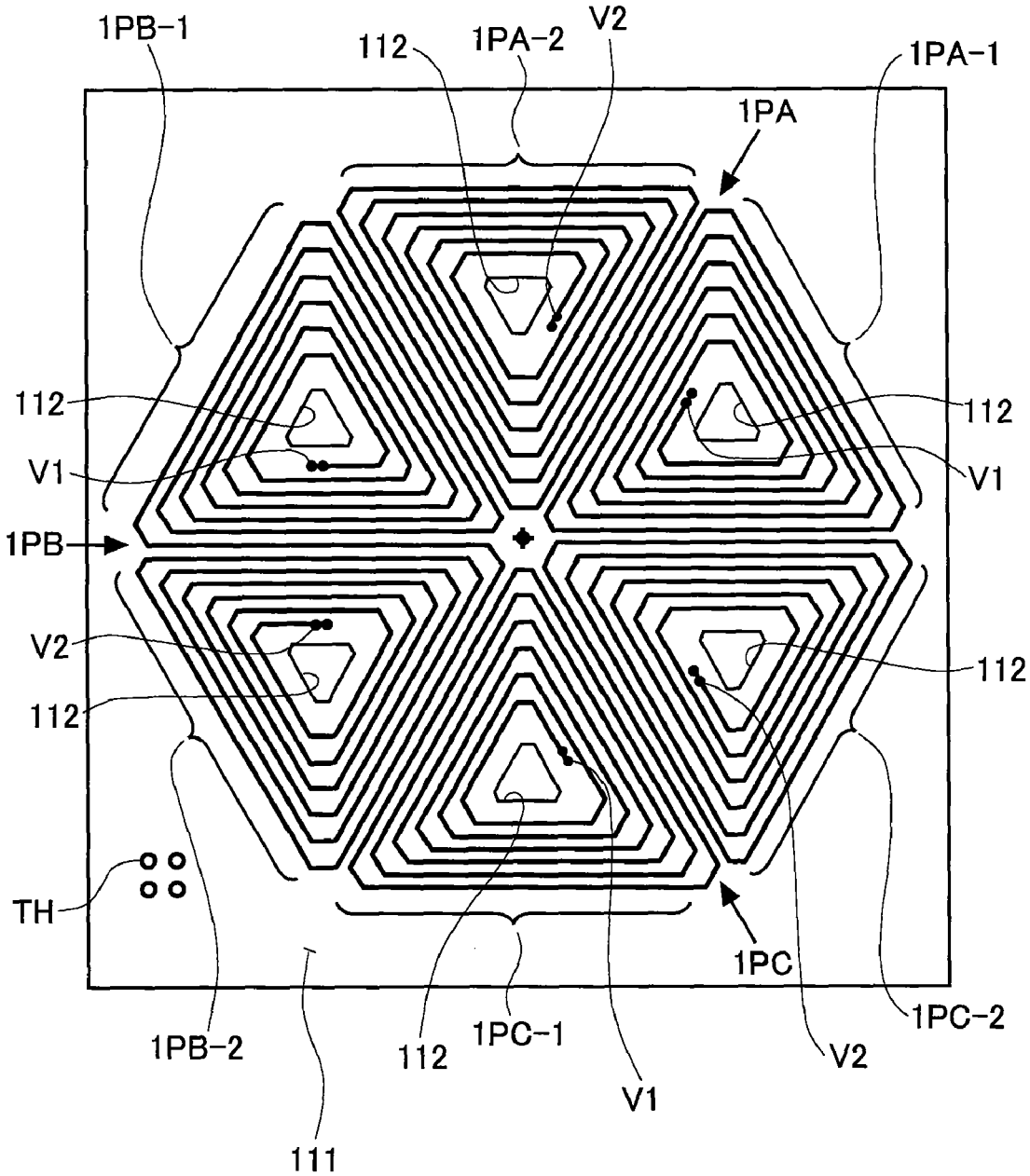
FIG. 12 is a plain view of a board (B1) composing a first layer winding pattern of a coil device (cored) of the present invention.
Figure 13:
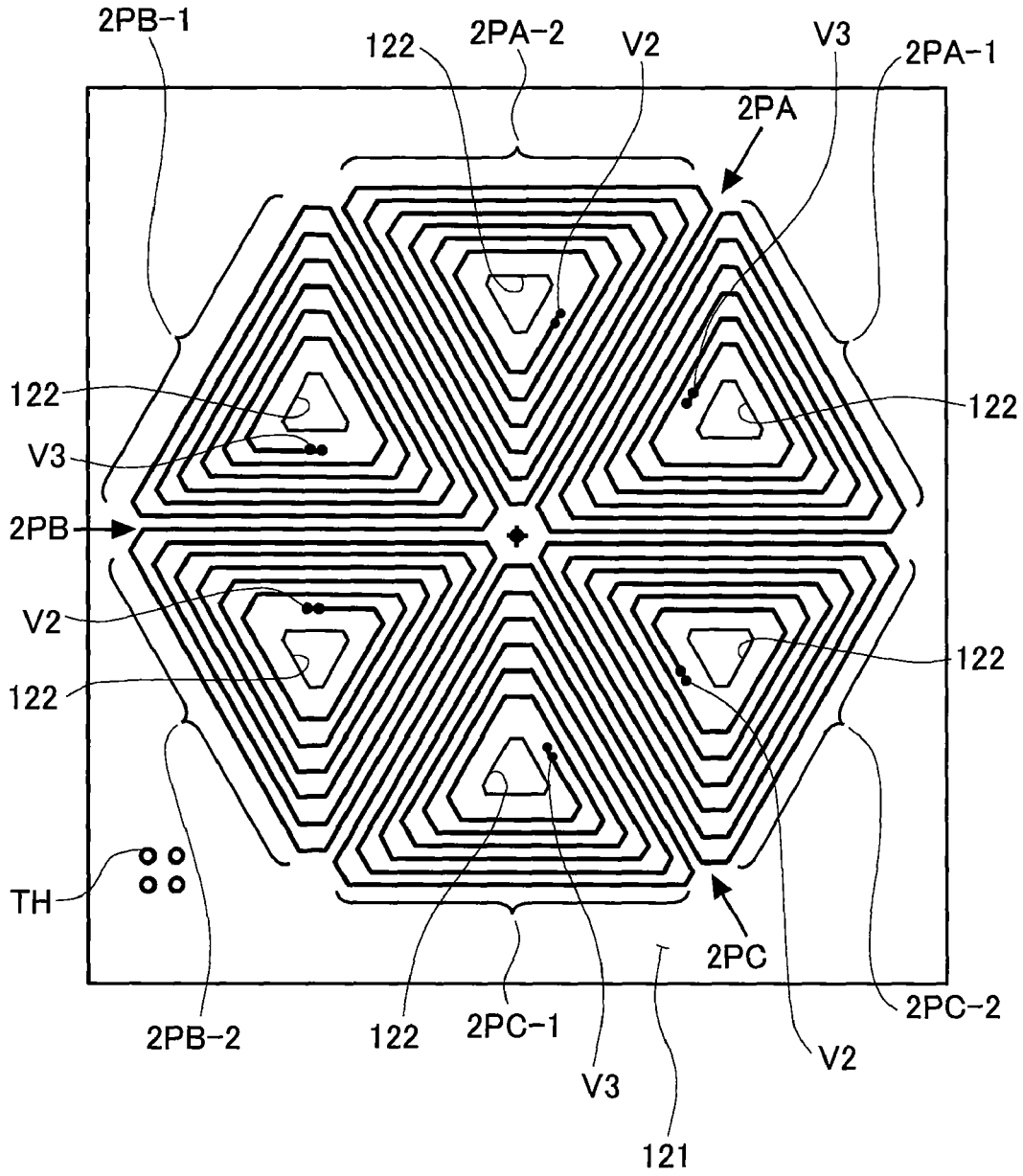
FIG. 13 is a plain view of board (B2) composing a second layer winding patterns of a coil device (cored) of the present invention.
Figure 14:
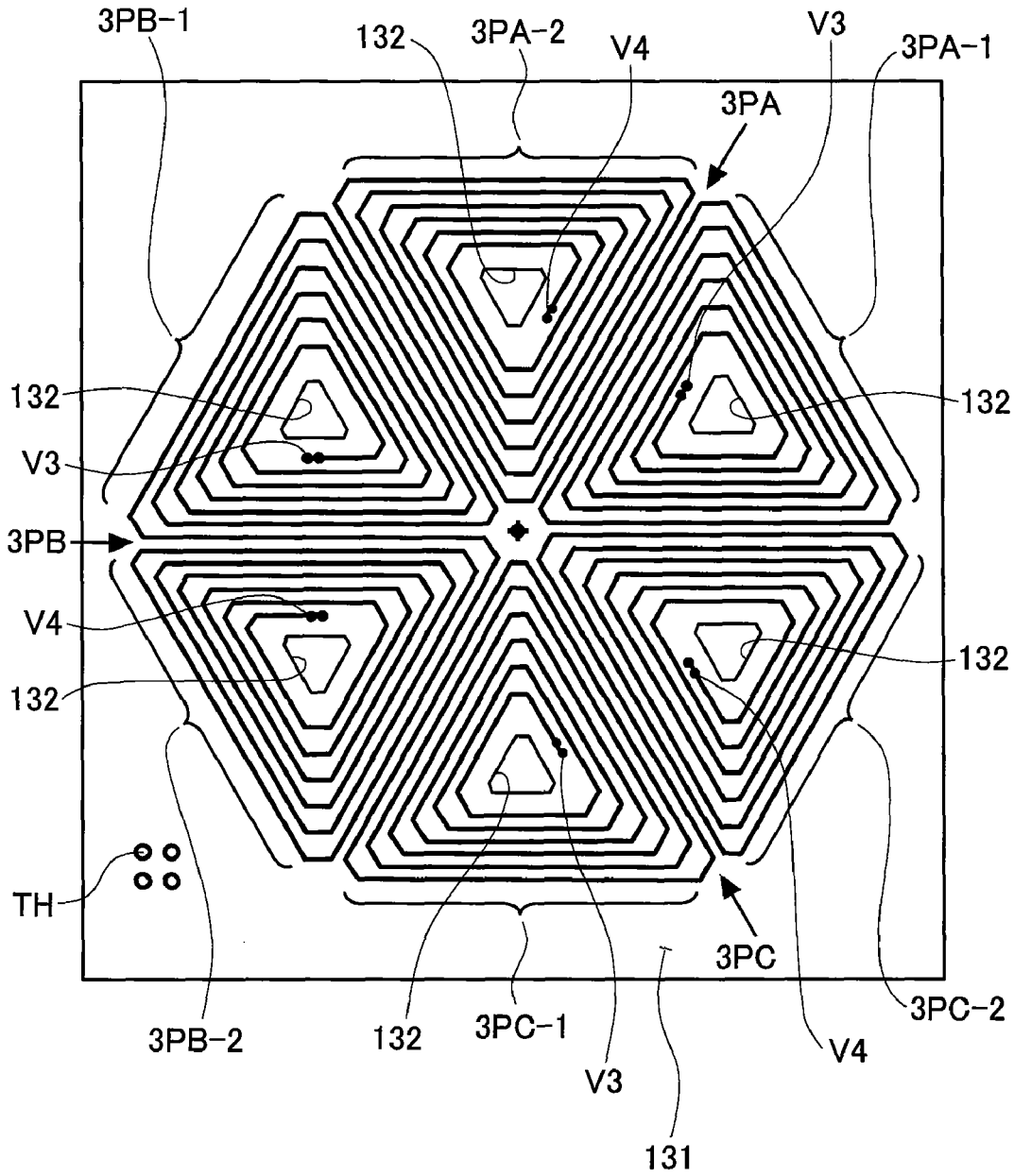
FIG. 14 is a plain view of board (B3) composing a third layer winding patterns of a coil device (core) of the present invention.
Figure 15:
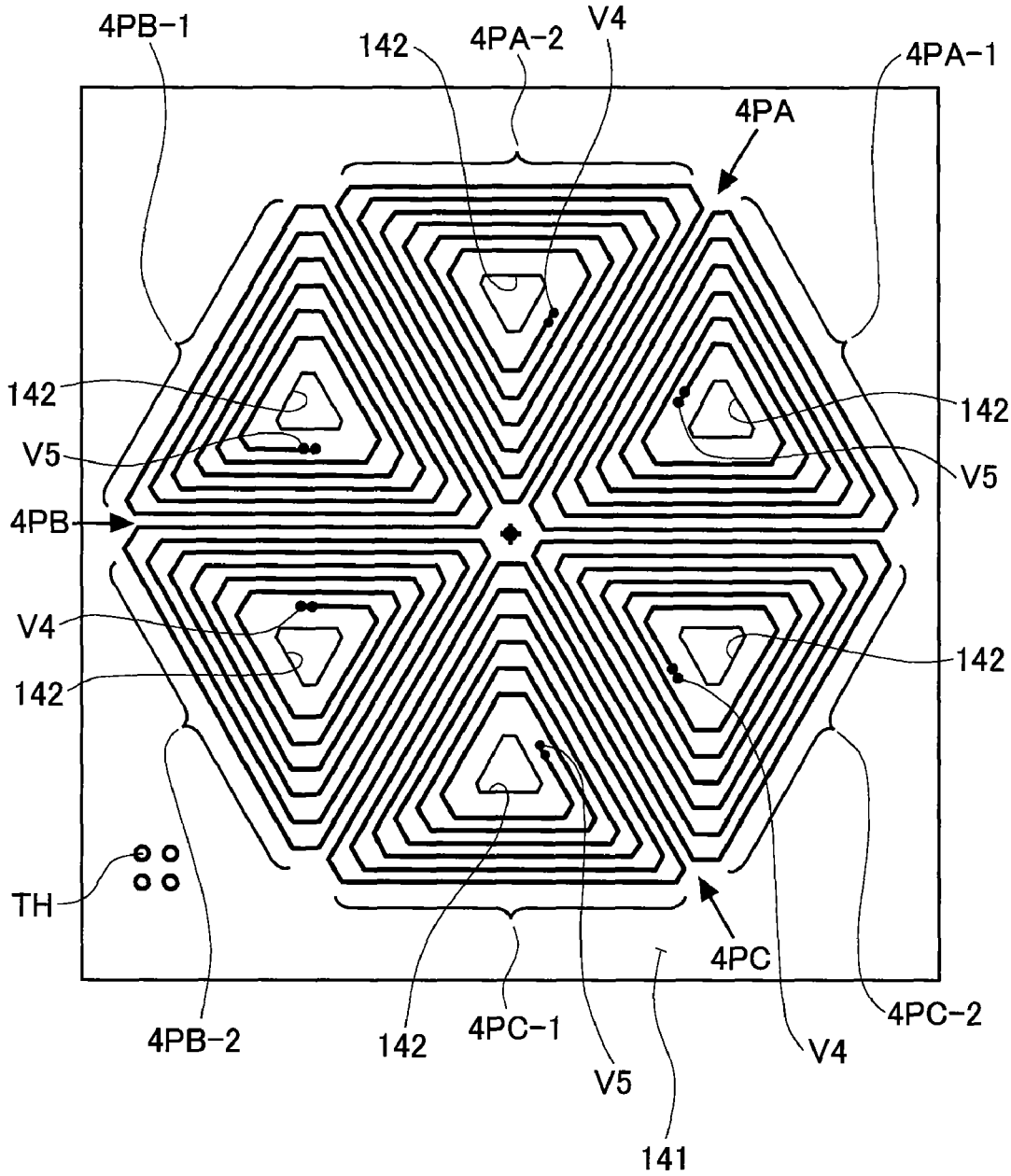
FIG. 15 is a plain view of board (B4) composing a fourth layer winding patterns of a coil device (core) of the present invention.
Figure 16:
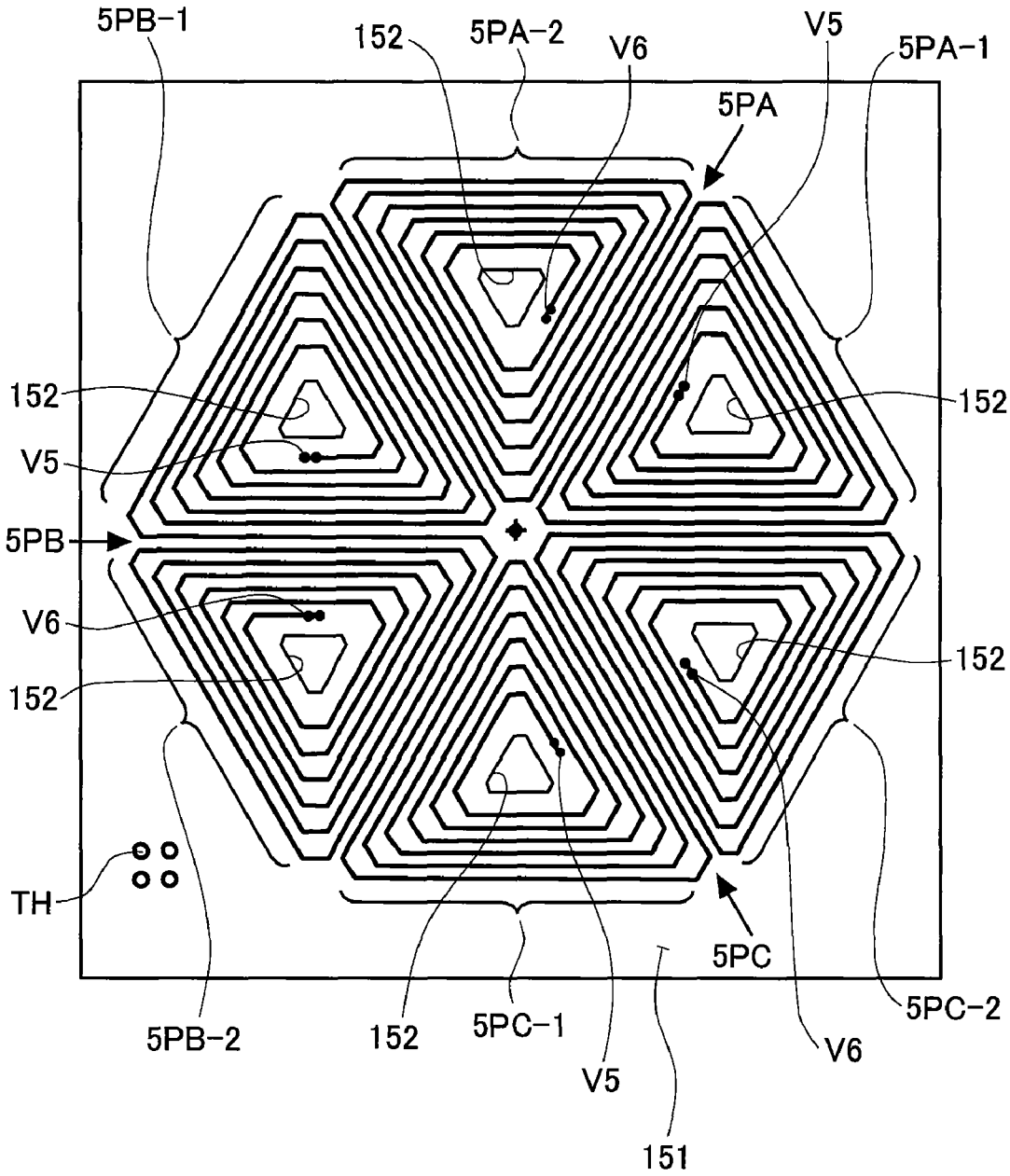
FIG. 16 is a plain view of board (B5) composing a fifth layer winding patterns of a coil device (cored) of the present invention.
Figure 17:
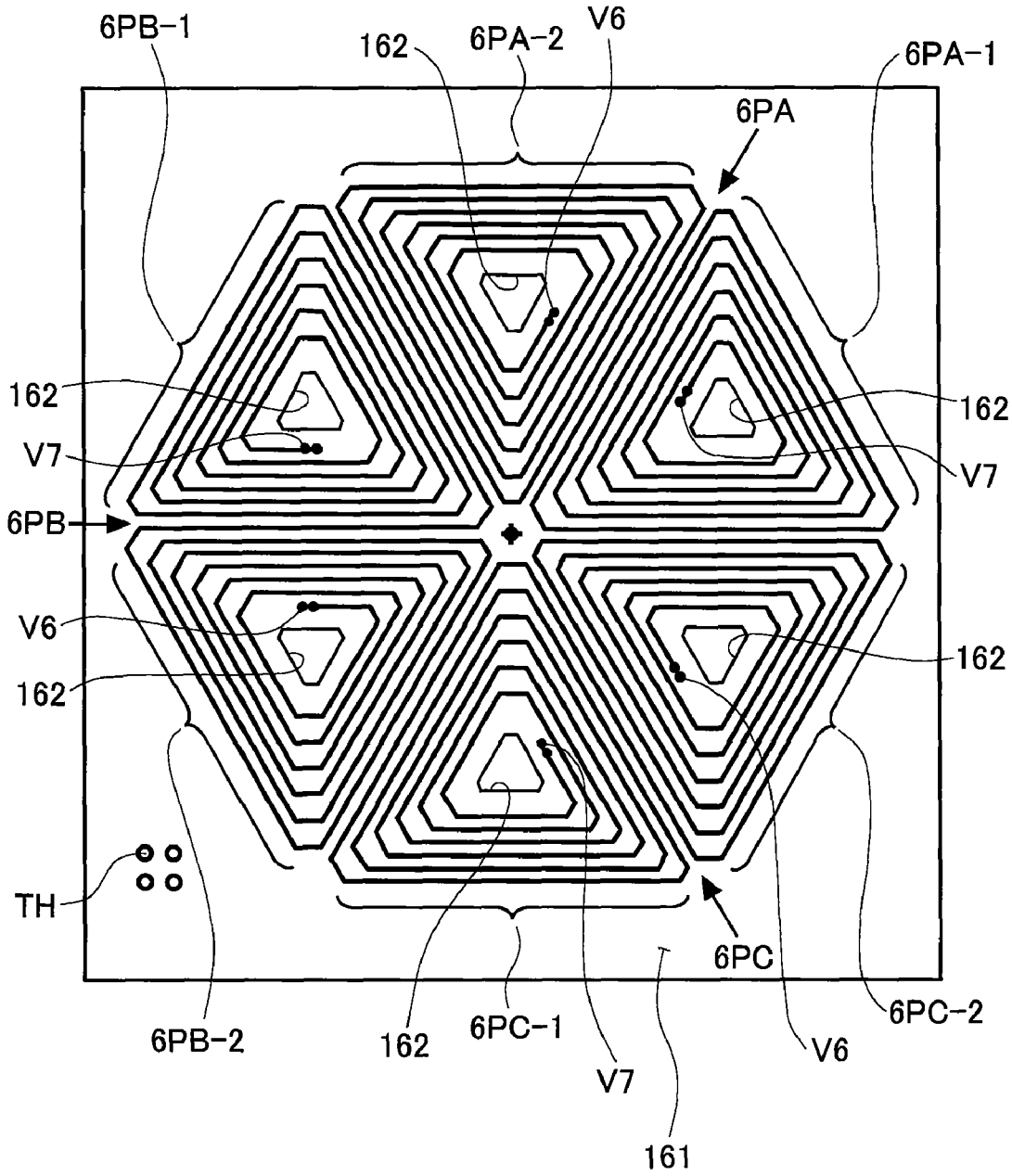
FIG. 17 is a plain view of board (B6) composing a sixth layer winding patterns of a coil device (cored) of the present invention.
Figure 18:
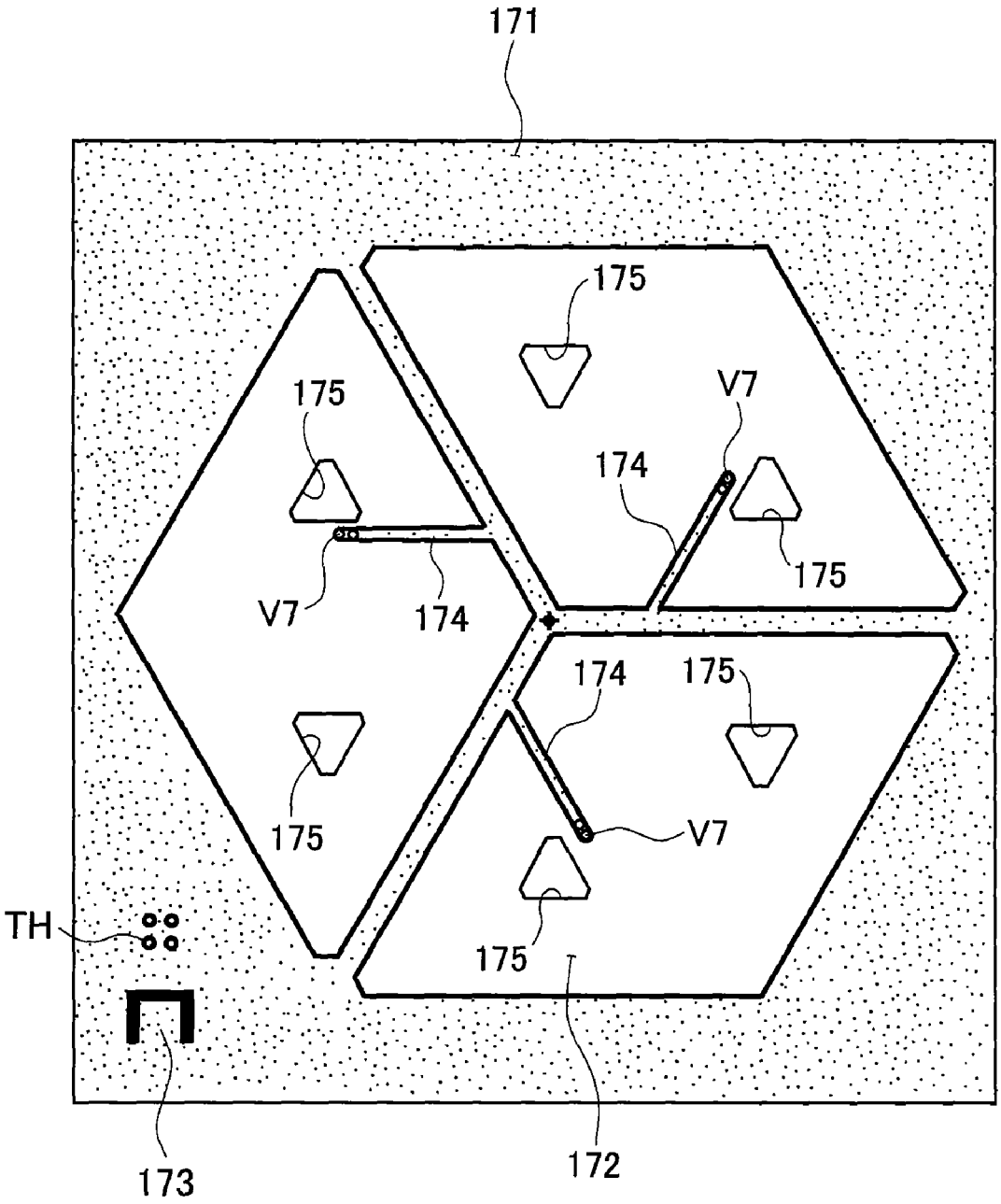
FIG. 18 is a bottom view of board (L3) composing a lower side power source layer (GND) of a coil device (cored) of the present invention.
Figure 19:
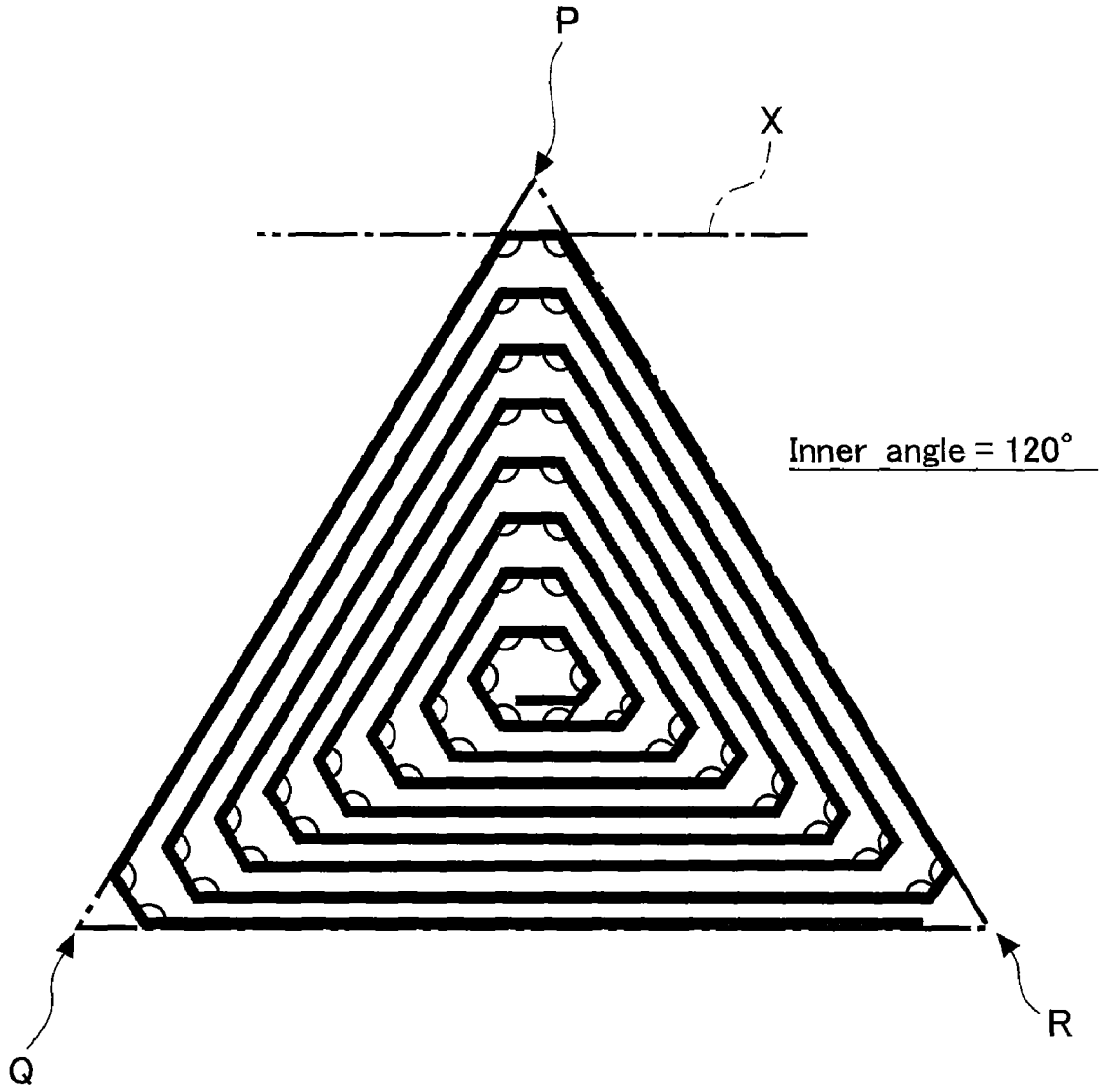
FIG. 19 is an explanatory drawing illustrating countermeasures for a heat generation due to high frequency alternate current.
Figure 20:
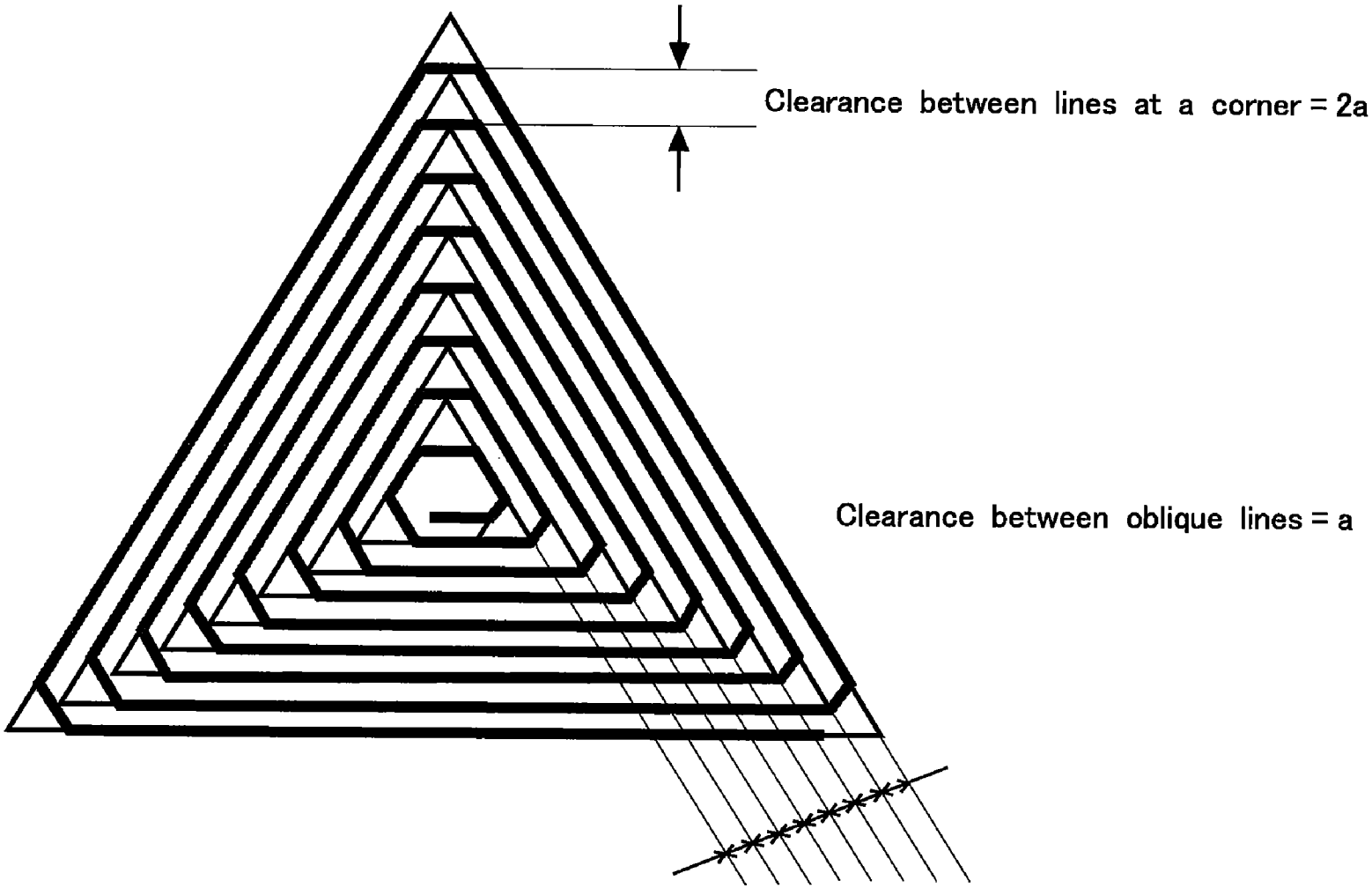
FIG. 20 is an explanatory drawing illustrating design values of clearances between oblique side lines and side lines at each of corners.
Figure 21:
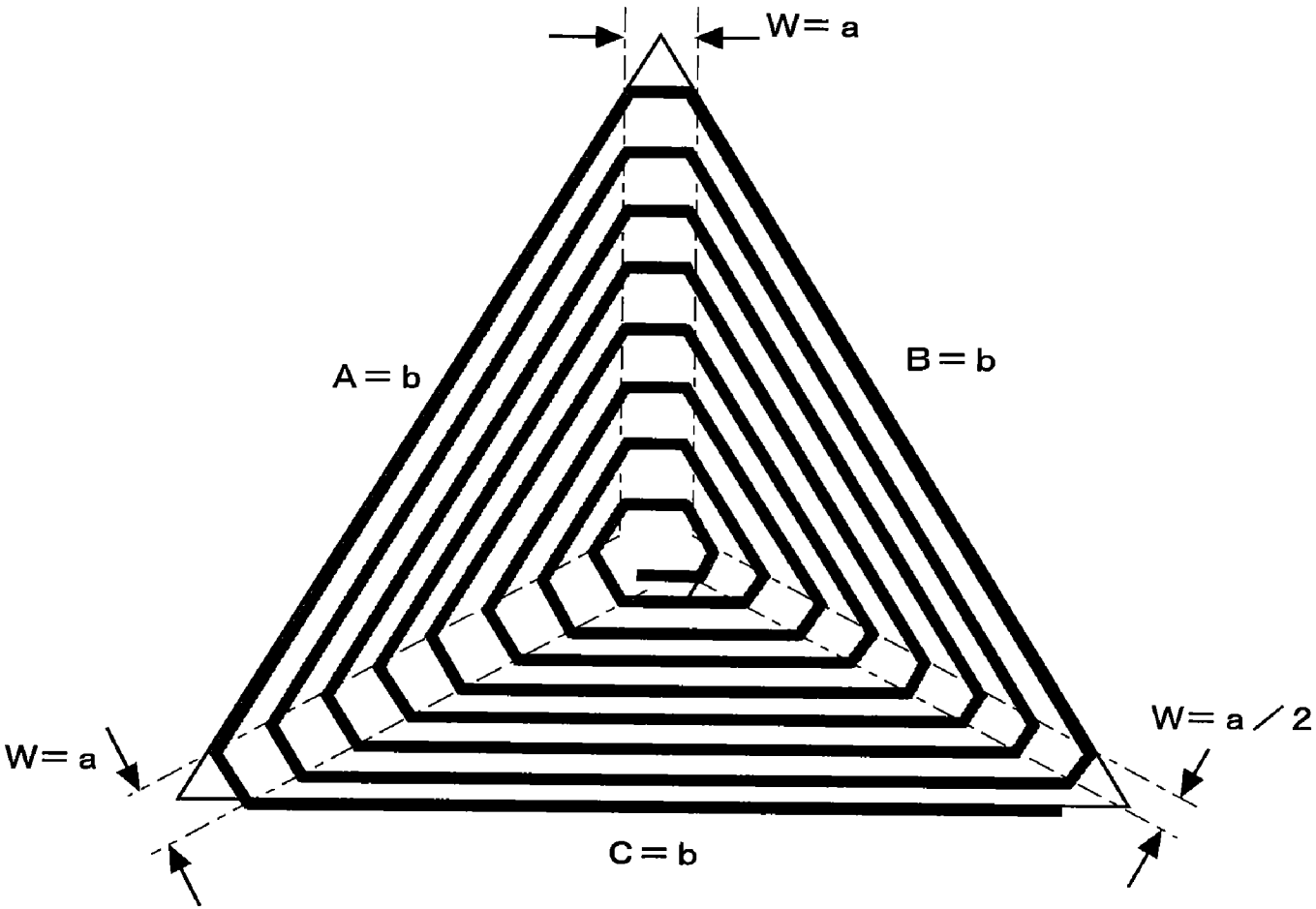
FIG. 21 is an explanatory drawing illustrating design values of measurements at portions of a first portion composing a basic pattern.
Figure 22:
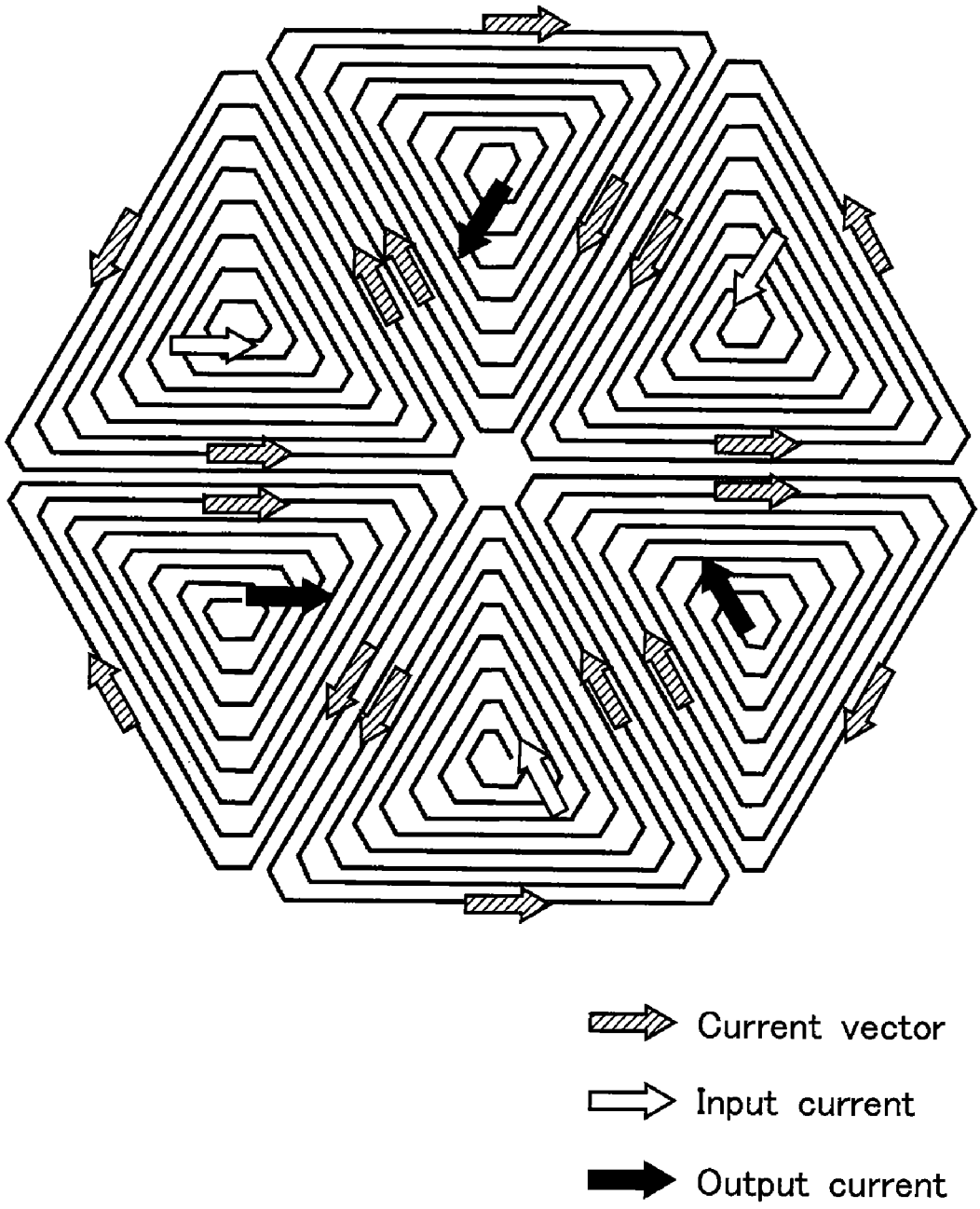
FIG. 22 is an explanatory drawing illustrating current vectors flowing though linear conductors adjacent to each other between unit patterns.
Figure 23:
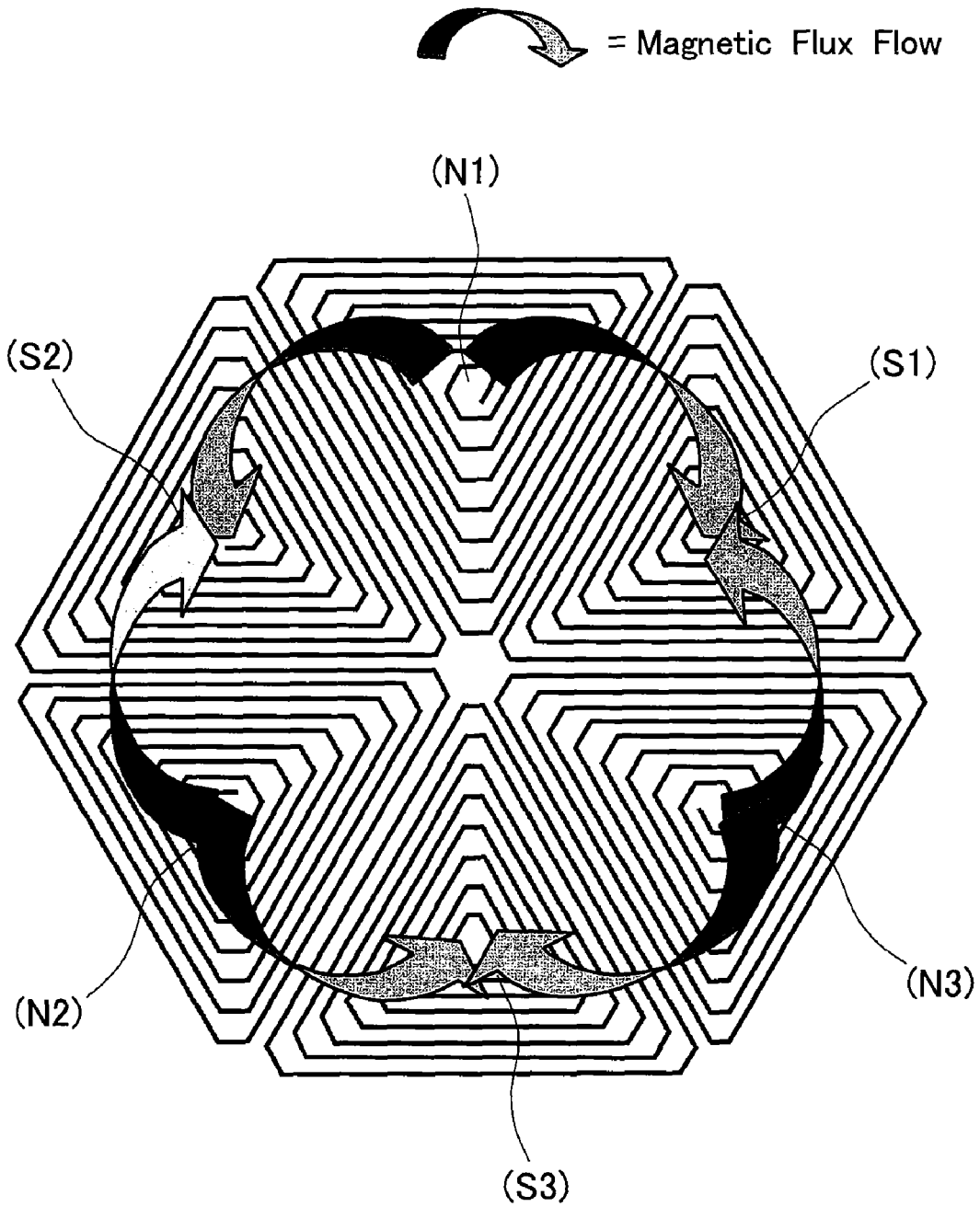
FIG. 23 is an explanatory drawing illustrating magnetic flux flow when three unit patterns are combined to form a polygonal shape.
Figure 24:
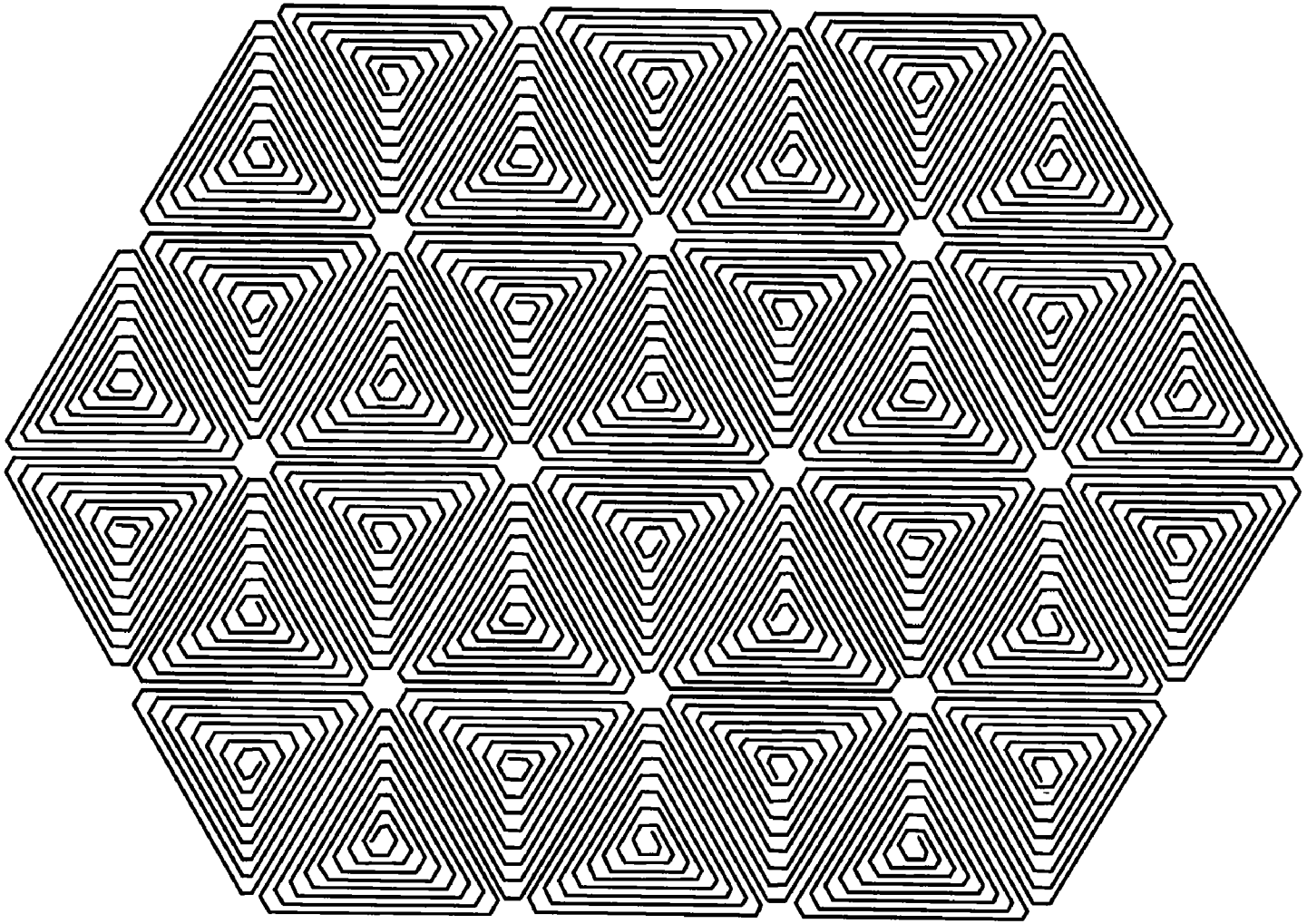
FIG. 24 is an explanatory drawing illustrating when sixteen unit patterns are combined to form a polygonal shape.
Figure 25:
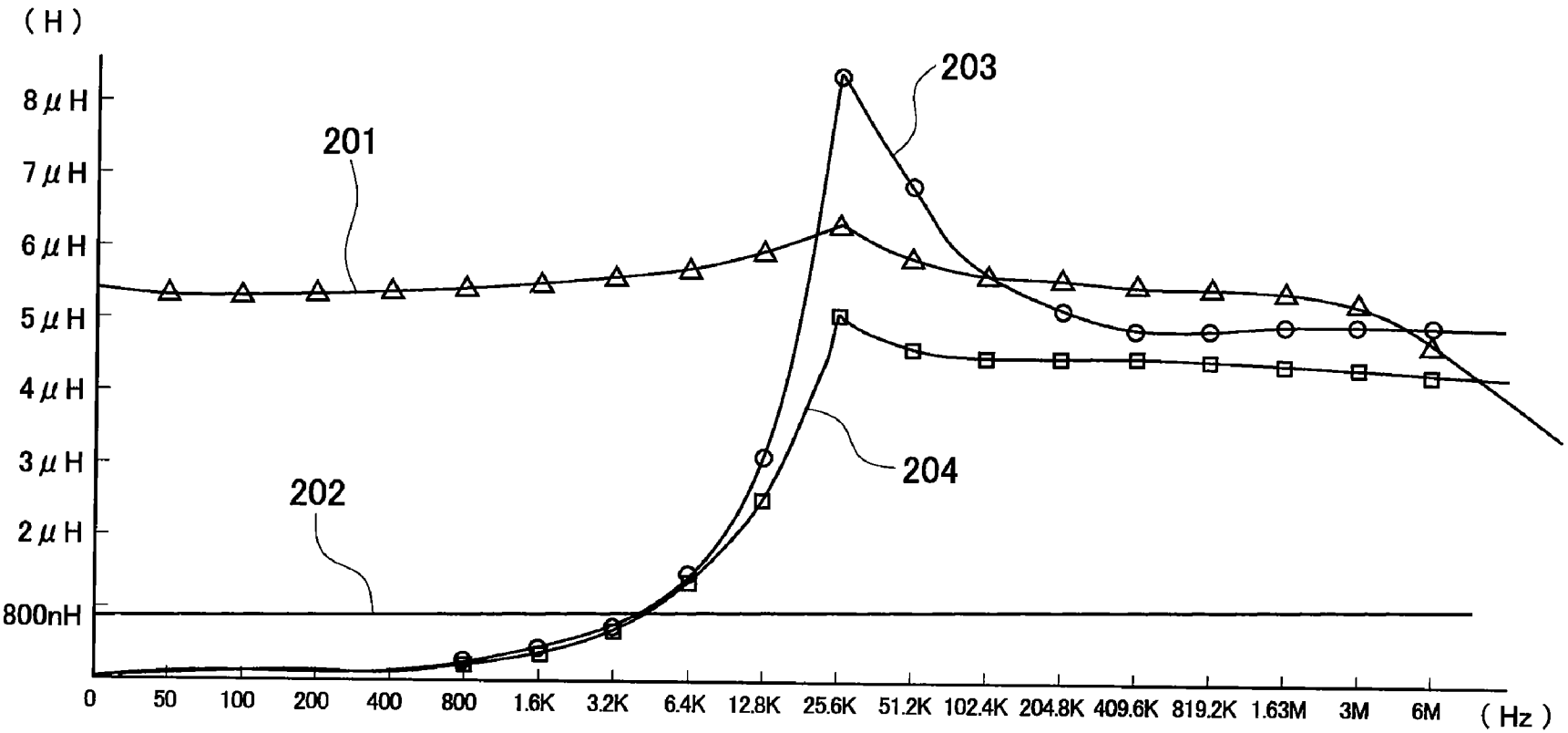
FIG. 25 is a graph showing a frequency characteristics of inductance of the present coil comparing with that of other coils.

101, 172 conductive coating area
102, 702 lead pattern
103, 111, 121, 131, 141, 151, 161, 171 board material exposure area
104, 112, 122, 132, 142, 152, 162, 172 core penetrating hole
173 GND terminal
P unit pattern
P-1 first portion
P-2 second portion
PA, PB, PC unit pattern
PA-1, PB-1, PC-1 first portion of nit pattern
PA-2, PB-2, PB-2 second portion of unit pattern
1P-6P winding pattern of each of layers
B1-B6 winding board of each of layers
L1 upper side insulating coating
L2 upper side power source (VDD) layer
L3 lower side power source (GND) layer
L4 lower side insulating coating
v1-v7 via
TH, H through hole
IM, 5M, 6M sharing portion
K1, K2 tubular coil

The invention claimed is:

1. Coil device, comprising, a plurality of flat coils, a flat coil carry layer for carrying the flat coils arrayed in a plane, a first interconnection layer provided on one side of the flat coil carry layer, and a second interconnection layer provided on the other side of the flat coil carry layer, thereby achieving a parallel electrical connection of the flat coils arrayed in the plane between the first and the second interconnection layers, wherein, the flat coils are each composed of a laminated coil formed by stacking a plurality of basic conductor patterns in layers, the basic conductor patterns are each formed into a nearly S-shaped pattern having two spiral winding patterns configured by spirally winding prescribed turns a linear conductor in opposite direction about two paralleled axes, the two spiral winding patterns composing each of the basic conductor patterns are each formed into a regular triangular shape and are arranged in back to back manner with sharing each of outermost circumferential base side lines, thereby achieving the basic conductor pattern of rhombic S-shape as a whole.

2. A coil device according to claim 1, wherein a plurality of the basic conductor patterns each having rhombic S-shape are regularly-arrayed in each of layers such that outer most circumferential side lines adjacent to each other between the basic patterns are in parallel to each other, and the each of spiral winding patterns are axially aligned with each other between layers by each of corresponding spiral patterns.

3. A coil device according to claim 2, wherein each of corners of the two regular triangles composing the basic pattern is cut off along a line perpendicular to a bisector of the corner so that inner angles of corners included in the linear conductor are all 120 degrees.

4. A coil device according to claim 1, wherein the coil device is produced using manufacturing technology applied to multilayer print connecting boards.

5. A coil device according to claim 1, wherein the coil device is produced using manufacturing technology applied to semiconductor integrated circuits.

* * * * *